US008973193B2

(12) United States Patent
Codos

(10) Patent No.: US 8,973,193 B2
(45) Date of Patent: Mar. 10, 2015

(54) METHODS OF OPTIMIZING A PRESSURE CONTOUR OF A PRESSURE ADJUSTABLE PLATFORM SYSTEM

(71) Applicant: Richard N. Codos, Warren, NJ (US)

(72) Inventor: Richard N. Codos, Warren, NJ (US)

(73) Assignee: Richard N. Codos, Warren, NJ (US)

( * ) Notice: Subject to any disclaimer, the term of this patent is extended or adjusted under 35 U.S.C. 154(b) by 55 days.

(21) Appl. No.: 13/827,021

(22) Filed: Mar. 14, 2013

(65) Prior Publication Data

US 2014/0041127 A1 Feb. 13, 2014

Related U.S. Application Data

(60) Provisional application No. 61/680,870, filed on Aug. 8, 2012.

(51) Int. Cl.
*A47C 27/08* (2006.01)
*A47C 27/10* (2006.01)

(52) U.S. Cl.
CPC ..... *A47C 27/083* (2013.01); *A47C 27/10* (2013.01)
USPC ..... 5/713; 5/706; 5/710

(58) Field of Classification Search
CPC ..... A61G 7/05769; A61G 7/05776; A61G 2203/34; A61G 7/05715; A61G 7/05; A47C 27/081; A47C 27/082; A47C 27/10; A47C 27/083
USPC ..... 5/706, 710, 713
See application file for complete search history.

(56) References Cited

U.S. PATENT DOCUMENTS

| | | | | |
|---|---|---|---|---|
| 5,170,364 | A * | 12/1992 | Gross et al. | 702/139 |
| 6,468,234 | B1 * | 10/2002 | Van der Loos et al. | 600/595 |
| 6,546,580 | B2 * | 4/2003 | Shimada | 5/710 |
| 6,560,803 | B2 * | 5/2003 | Zur | 5/654 |
| 7,685,658 | B2 * | 3/2010 | Lokhorst et al. | 5/424 |
| 8,533,879 | B1 * | 9/2013 | Taylor | 5/713 |
| 2009/0106905 | A1 * | 4/2009 | Ochi et al. | 5/713 |
| 2010/0000020 | A1 * | 1/2010 | Poulos | 5/713 |
| 2010/0170043 | A1 * | 7/2010 | Young et al. | 5/706 |
| 2011/0308019 | A1 * | 12/2011 | Terawaki et al. | 5/713 |
| 2013/0145558 | A1 * | 6/2013 | Bhai | 5/710 |
| 2013/0263378 | A1 * | 10/2013 | O'Keefe et al. | 5/713 |

* cited by examiner

*Primary Examiner* — Robert G Santos
*Assistant Examiner* — Richard G Davis
(74) *Attorney, Agent, or Firm* — Klauber & Jackson LLC

(57) ABSTRACT

The present invention provides a method of optimizing a pressure contour of a pressure adjustable platform system by (a) measuring pressure in a plurality of bladders in the pressure adjustable platform system; (b) assessing whether a change in pressure in one or more of the plurality of bladders occurs; (c) determining whether a subject on the pressure adjustable platform system has adjusted position, moved or tossed; (d) generating an adaptive sleep algorithm; and (e) adjusting the pressure in one or more bladders.

30 Claims, 30 Drawing Sheets

Adaptive Bladder Pressure Adjustment
(Curve #1)

Adaptive Bladder Pressure Adjustment
(Curve #2)

Adaptive Bladder Pressure Adjustment
(Curve #3)

Adaptive Bladder Pressure Adjustment
(Curve #4)

Adaptive Bladder Pressure Adjustment
(Curve #10)

METHODS OF OPTIMIZING A PRESSURE CONTOUR OF A PRESSURE ADJUSTABLE PLATFORM SYSTEM

CROSS REFERENCE TO RELATED APPLICATION

The present application is based upon and hereby claims priority to U.S. Provisional Patent Application No. 61/680,870, filed Aug. 8, 2012 and the content of said Provisional patent application is hereby incorporated herein by reference in its entirety.

BACKGROUND OF THE INVENTION

Many different patient support systems and sleep platforms have been designed that utilize individual or group bladder control to support a sleeper. The health benefits and sleep benefits of reducing pressure points on a sleeper are well documented. Such sleep platforms attempt to measure the force on a bladder, or a group of bladders, and reduce the pressure in the corresponding bladder(s) to effect pressure reductions in areas where high sleeper interface forces are detected.

Skinner et al., U.S. Pat. No. 7,883,478 describe a patient support having real time pressure control. Each bladder in this support is subtended by a force sensor that is able to sense a force that is transmitted through the inflatable bladder. The apparatus uses the force sensors to determine position and movement of a person lying on the bladders so that the bladder air pressure can be adjusted to match the person's position and movement. The apparatus controls individual bladder sections with individual pneumatic valves Bobey et al., U.S. Pat. No. 7,698,765 describe a patient support having a plurality of vertical, inflatable bladders. The support system has an interior region that is defined by a top portion and bottom portion of a cover that define an interior region. Within the interior region can shaped bladders and force sensors are provided. The force sensors configured to measure pressure applied to one or more of the bladders. A separate sensor sheet is required to be external to the base and internal to the interior region that subtends the bladder region. Pressure transducers may be coupled to an individual bladder to measure the internal pressure of fluid within the bladder.

Gusakov, U.S. Pat. No. 5,237,501 describes an active mechanical patient support system that includes a plurality of actuator members that are controlled via a central processor. Associated with each actuator is a separate displacement transducer for determining the extension of the actuator. In addition, each actuator has a separate force sensor for determining the force on that actuator. A control means is provided to control the displacement of each actuator connected or integral to each actuator. In addition to individual force sensors associated with each individual actuator, a separate displacement transducer is utilized to determine the exact extension of each actuator member. This displacement transducer is required since the actuator is of a style that approximates a cylinder actuator. When loaded with a constant mass a cylinder actuator will maintain a constant subtended force measurement regardless of variations in the cylinder extension. Therefore, in order to determine the cylinder height, a displacement transducer is required.

Kramer et al., U.S. Pat. No. 7,409,735 describe a cellular person support surface. The support surface is composed of a plurality of inflatable cells, each of which has an associated pressure sensor corresponding to one of the plurality of inflatable cells. At the same time, each inflatable cell has one associated driver corresponding to one of the plurality of inflatable cells that is capable of inflating and deflating the associated cell. The patent requires an individual pressure sensor, as well as an individual inflation and deflation driver for each cell, or group of cells, that is being controlled. In the case of this patent, the sensors and drivers are located within the internal walls of the associated cell.

All of the existing patient support systems and sleep platforms suffer from the high cost and complexity associated with requiring individual control means, displacement transducers, and force sensors for each actuator. To mitigate this cost and complexity, some of these existing patient support systems and sleep platforms propose distributing both the control means and sensing means over multiple bladders or actuators. This requires that the multiple bladders or actuators be fluid coupled to one another and have one fluid stream interconnected between the multiple bladders. This results in a decreased ability to control and sense small areas of the sleep surface. The effect is an increased granularity in both sense and control of the sleep surface. Furthermore, the control means for controlling each actuator's displacement is both expensive and complex. The primary function of the subtended force sensors is to determine sleeper location and position, as well as absolute sleeper weight.

In all of the existing patient support systems and sleep platforms, a pressure sensor that subtends an actuator or bladder, or group of actuators or bladders, continues to read a constant force as long as the sleeper maintains his or her position. Some existing patient support systems and sleep platforms attempt to reduce the actuator pressure when a determination has been made, via the subtended force sensors, that the associated actuator or bladder is being subjected to forces above some established threshold force. By reducing fluid volume in the corresponding bladder, the height of that same bladder is also reduced. Once the fluid volume is reduced so that the corresponding height of the bladder is reduced to a level equal or below the surrounding bladders, the load on the bladder is partially or fully transferred to the surrounding bladders. This results in a pressure reduction on the sleeper from the above threshold bladder.

Beds and Mattresses have remained virtually unchanged over the centuries. Featherbeds are, from a technological point of view, little different from foam or spring beds. Once the aesthetically pleasing quilted mattress cover or ticking is removed, the actual active mattress components are little more than passive spring systems functioning in a similar manner to that of the feathers in a featherbed. All mattresses, whether they are made of individual coil springs, pocket coil springs, high tech foam, overall spring assemblies, or air bladders with adjustable firmness settings, passively adjust to a sleepers' movement. Even accounting for the latest adjustable firmness air bladder mattresses, the resulting active mattress component is nothing more than an adjustable firmness passive air spring. It is generally accepted that reducing high pressure points increases comfort and hence results in better sleep. Beyond reducing pressure points, no other active system has been proposed to improve sleep patterns. A sleep system that can optimize the underlying pressure profile of the sleeper in order to adaptively improve the resultant sleep patterns over several hours or days of sleep is needed.

SUMMARY OF THE INVENTION

The present invention provides a pressure adjustable platform system and methods for adjusting the interface pressure between the support surface and an individual on the surface as well as methods for optimizing the contour of the interface pressure between the support surface and an individual on the surface. Such methods for optimizing the contour of the interface pressure between the support surface and an individual on the surface may provide better quality of rest or sleep and may effectively constitute methods for optimizing or improving sleep.

In one aspect, the present invention provides a method of optimizing a pressure contour of a pressure adjustable platform system by (a) measuring pressure in a plurality of bladders in the pressure adjustable platform system; (b) assessing whether a change in pressure in one or more of the plurality of bladders occurs; (c) determining whether a subject on the pressure adjustable platform system has adjusted position, moved or tossed; (d) generating an adaptive sleep algorithm; and (e) adjusting the pressure in one or more bladders.

The method may further include after (b), determining a number of the plurality of bladders experiencing a change in pressure. Also, the method may further include after (d), providing a pressure image of the subject on the pressure adjustable platform system. The method may further include after (d), providing a pressure profile curve. The (c) determining whether a subject on the pressure adjustable platform system has adjusted position, moved or tossed may be performed by determining the number of bladders that have experienced a significant change in pressure. A significant change in pressure may be at least a 5%, 10%, 15%, 20% or so fluctuation in pressure within a bladder.

The (d) generating an adaptive sleep algorithm may be performed by generating a total sleeper movement number (TSMN). Such a total sleeper movement number (TSMN) may reflect quality of sleep, and the total sleeper movement number (TSMN) may be repeatedly generated. In some instance, the (e) adjusting the pressure in one or more bladders may be performed using a pressure profile curve. The method may also further include after (d), providing a position profile curve. The (d) generating an adaptive sleep algorithm may include the steps of quantifying minor tosses and major tosses. In many instances, the (e) adjusting the pressure in one or more bladders is performed repeatedly, and the time between one or more repeats is measured.

The methods may further include assessing quality of sleep of an individual on the pressure adjustable platform system, and the assessing quality of sleep of an individual on the pressure adjustable platform system may include calculating a total sleep movement number (TSMN) a sleep movement time (SMT) and a sleep quality number (SQN).

The methods may be especially useful when practiced with a pressure adjustable platform system having a plurality of bladders, a base plate, and a plurality of fluid channels wherein the fluid channels connect the bladders to an external sensor, wherein internal pressure of a plurality of the bladders may be adjusted.

DETAILED DESCRIPTION OF THE PREFERRED EMBODIMENTS

Figure 1:
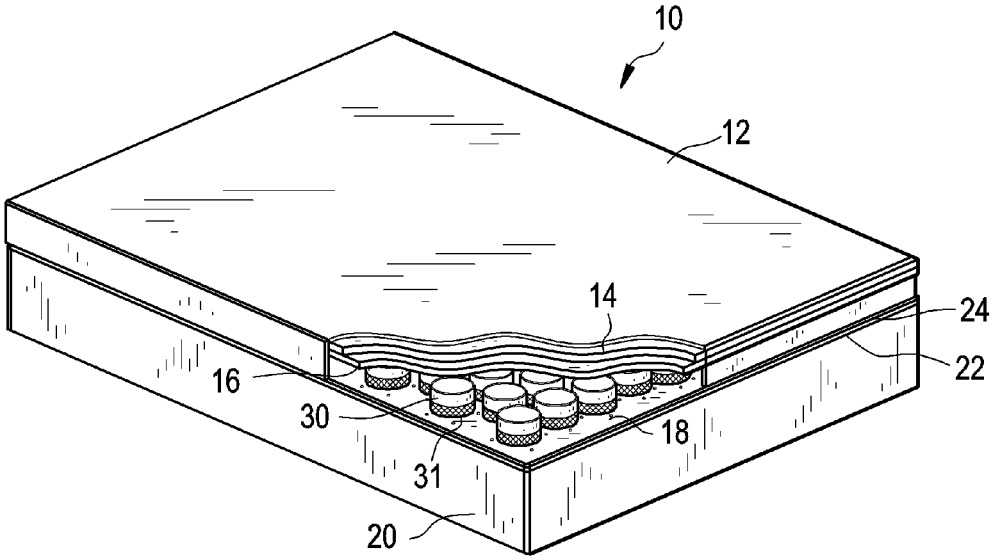
FIG. 1 is a perspective view with a cutaway showing the bladder assembly of a sense, react, and adapt sleep apparatus.

The methods described herein utilize a computer to monitor every individual pneumatic bladder, or electronic spring, and provide the ability to actively sense and adjust the pressure of every bladder within seconds. At the same time, a sleeper's overall sleep patterns are monitored. Sleeper movements and position changes are charted over the course of a sleep episode. This allows a computer to adapt the individual bladder's pressure to optimize the sleeper's best sleep pattern. Over a period of hours, or as long as multiple episodes, the computer's sleep algorithm fine tunes the sleeper's adaptive sleep system with a resulting deeper sleep pattern with fewer periods of restlessness and wakening. This sleep improvement is quantified by analyzing the number of sleep movements and position changes over a known time period. Hour to hour and day to day improvements can be quantified by a reduction in the number of sleeper movements and position changes. In essence, the present methods allow quantifying a more "restful night" of sleep. These improved adaptive sleep patterns are charted over the course of a night's sleep. The sleeper can witness his or her actual sleep improvement with the graphical tools provided by the sleep system. The sleep system communicates with an individual via a remote computer or tablet to let them see their sleep improvement. At the same time, adaptive sleep system tools allow the sleeper to monitor, and analyze, their sleep data. The sleeper also has the ability to subjectively rate their night's sleep. The adaptive sleep algorithm takes into account the sleeper's subjective rating in determining the best available sleep pressure curve and sleeper profile.

All bladders are inflated to a base pressure before the individual moves onto the mattress and it is unloaded. The base pressure may be, for instance, 0.20, 0.30, 0.40, 0.50, 0.60 or so pounds per square inch (psi) above atmosphere. All pressures are defined as gauge pressure (gauge pressure=total pressure−1 atmosphere). At this time a total sleeper movement number (TSMN), that keeps track of the number of tosses and turns of a sleeper, is initialized to zero. A sleeper movement timer (SMT) that measures when the TSMN was last reset to zero is also set to zero and started to begin measuring elapsed time in, for instance, minutes. A sleeper quality number (SQN) that measures the quality of sleep (SQN=1/(TSMN/SMT)) is also reset to zero.

All bladder pressures are measured and recorded in a first table. It is possible, for instance, to read about 150 or so bladders for a queen size mattress in 2 seconds (30 rpm on the valve reading all 150 bladders). In some instances, there may be about 200, 300, 400, 450, 500, 550 or so bladders present in a queen size mattress. Generally, the greater the number of bladders, the finer the granularity of pressure readings and pressure control.

After about 4 seconds (2 rotations of the control valve), the bladder pressures are measured again, and the pressure values are stored in a second table. The pressure values for each bladder from the first and the second table are compared. If a value deviation between an individual bladder's two readings as recorded in the first and second table is greater than about 5%, 10%, 15%, 20%, 25% or so, preferably greater than about 10%, then it is possible to conclude that a significant change in pressure on the associated bladder has occurred. Next, it is possible to assess or total all of the significant pressure changes for all bladders.

If less than a preset number, for instance, 2, 5, 10, 15, 20, 25 or so, preferably 5, bladders have seen a significant pressure change then it is possible to judge that an individual has experienced minimal or no movement. The number of bladders used to determine if a movement has occurred is subject to the number of the total number of bladders on the platform and the size of the platform.

If greater than a preset number, for instance, 2, 5, 10, 15, 20, 25 or so, preferably 5, bladders have experienced a significant pressure change, then it is possible to judge that a small movement or toss has occurred for the individual. In this case, a minor toss "t" may be recorded along with the respective time into an individual's position table. At the same time, it is possible to increment a counter (mintoss) that keeps track of the total number of minor tosses. (mintoss=mintoss+1).

If greater than a preset number, for instance, 2, 5, 10, 15, 20, 25 or so, preferably 10, bladders have experienced a significant pressure change then it is possible to judge that a significant toss or actual turn of the sleeper has occurred. In this case, a major toss "T" may be recorded along with the respective time into an individual's position table. At the same time, it is possible to increment a counter (majortoss) that keeps track of the total number of major tosses. (majortoss=majortoss+1).

An image recognition algorithm may be used to determine an individual's position based upon the pressure values in the second table. The bladders on the platform form a bladder matrix, similar to how pixels on an image sensor form an image matrix. The actual bladder pressures can be translated into corresponding colors based upon their individual pressure values. The resultant image generated is a pressure image of an individual's position. This pressure image is compared to a known position pressure images for the individual, or in the case of no individual data a generic individual pressure map, to find a best match. The resulting image match may be used to determine which predetermined position the individual has assumed. Based upon the above position determination, it is possible to determine if the sleeper has changed positions from his or her last known position. If yes, the new position and time of position change is recorded in the sleeper's position table. If a position change has occurred then a counter (poschange) that keeps track of the total number of position changes (poschange=poschange+1) is entered.

An adaptive sleep algorithm may be generated. For purposes of the adaptive sleep algorithm, weighted values are assigned to minor tosses, major tosses, and position changes. A minor toss has a multiplier of 1. In some instances, a major toss has a multiplier of 5 while a position change has a multiplier of 5. By multiplying the number of minor tosses by their multiplication factor, adding the number of major tosses times their multiplication factor, and adding in the number of position changes by its multiplication factor, a new value for the total sleeper movement number (TSMN) is generated.

$$TSMN=(mintoss*1)+(majortoss*5)+(poschange*5).$$

The SQN (SQN=1/(TSMN/SMT)) may be calculated. As long as the SQN is greater than about 4 or 5 or 6, preferably, SQN>6, then the individual is considered to be experiencing a good quality of sleep. Therefore, no adjustments are made to the adaptive pressure profile. However, if the SQN is less than or equal to about 6, then an adaptive pressure profile adjustment is implemented.

A pressure profile curve is composed of a series of bladder pressure value adjustments based upon a given bladder pressure. In some instances, some of the pressure curves adjust as follows:

TABLE 1

| Pressure Curve #1 (Default): | |
|---|---|
| Bladder Pressure psi | Percentage Adjustment % of measured value |
| >1.50 | 50% |
| 1.3-1.50 | 55% |
| 1.1-1.29 | 60% |
| .90-1.09 | 70% |
| .70-.89 | 85% |
| .60-.69 | 90% |
| .50-.59 | 95% |
| <.50 | 100% |

Figure 22:
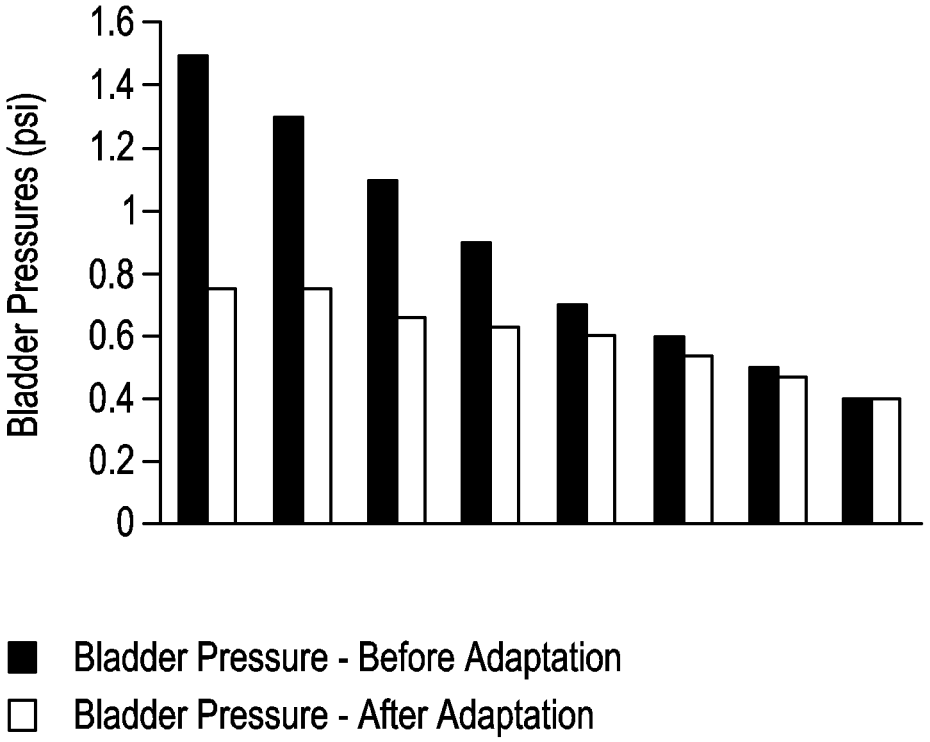
FIG. 22 is a bar graph representation of the adaptive pressure adjustment for pressure curve #1.

FIG. 22 is a bar graph representation of the adaptive pressure adjustment for pressure curve #1. Noting the height difference between the before and after bar charts demonstrates how the bladders that are at higher pressures have their pressures reduced proportionately more than those at lower pressures. Reducing pressure in bladders that read high non-adjusted pressures results in a physical lowering of the heights of these bladders. As the bladder height is reduced, the load on that bladder is partially transferred to the adjoining bladders in effect reducing the high pressure points on the sleeper by distributing the high pressure load to adjoining bladders.

TABLE 2

| Pressure Curve #2: | |
|---|---|
| Bladder Pressure psi | Percentage Adjustment % of measured value |
| >1.50 | 40% |
| 1.3-1.50 | 45% |
| 1.1-1.29 | 50% |
| .90-1.09 | 60% |
| .70-.89 | 75% |
| .60-.69 | 80% |
| .50-.59 | 85% |
| <.50 | 100% |

Figure 23:
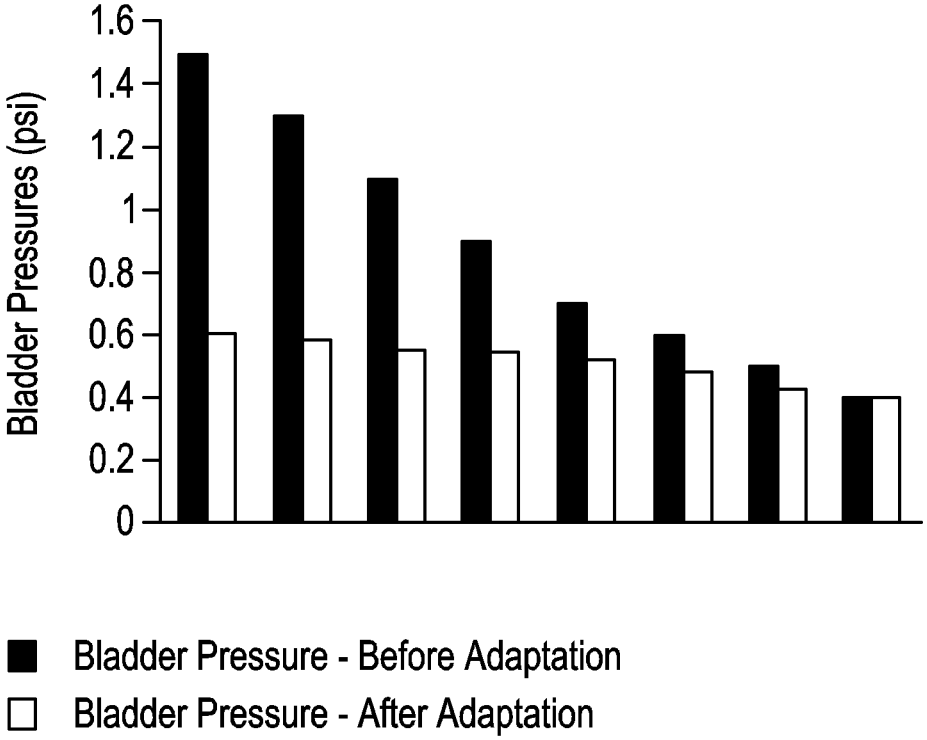
FIG. 23 is a bar graph representation of the adaptive pressure adjustment for pressure curve #2.

FIG. 23 is a bar graph representation of the adaptive pressure adjustment for pressure curve #2. Noting the height difference between the before and after bar charts demonstrates how bladders that are at higher pressures have pressures reduced proportionately more than those at lower pressures. The higher pressure bladders in curve#2 are reduced by a greater factor than those in curve#1.

TABLE 3

| Pressure Curve #3: | |
|---|---|
| Bladder Pressure psi | Percentage Adjustment % of measure value |
| >1.50 | 30% |
| 1.3-1.50 | 35% |
| 1.1-1.29 | 40% |
| .90-1.09 | 50% |
| .70-.89 | 65% |
| .60-.69 | 75% |
| .50-.59 | 95% |
| <.50 | 100% |

Figure 24:
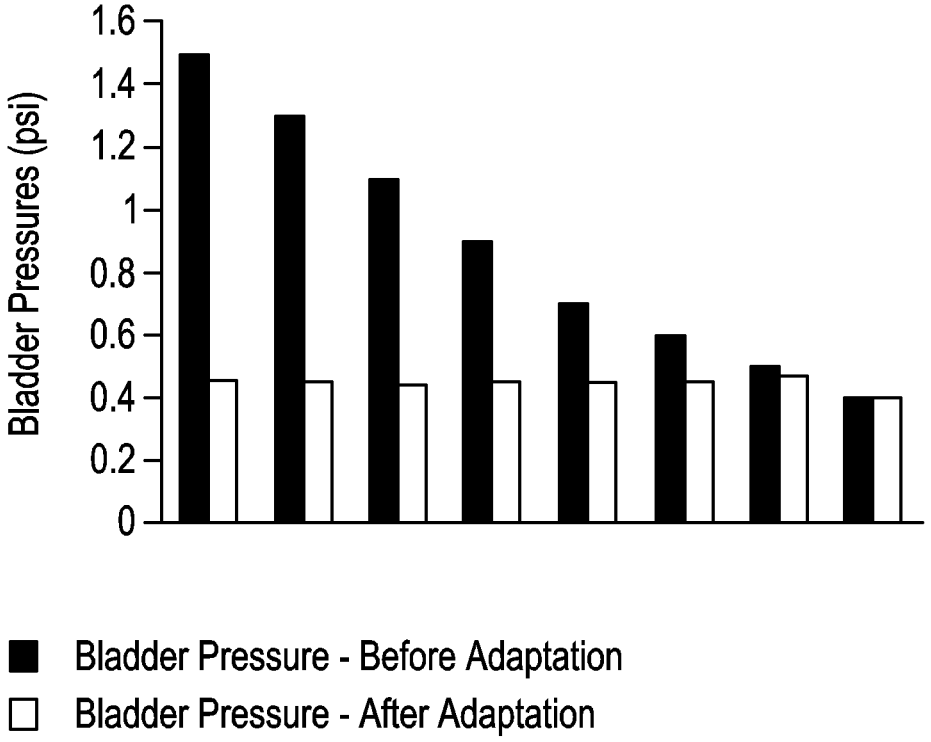
FIG. 24 is a bar graph representation of the adaptive pressure adjustment for pressure curve #3.

FIG. 24 is a bar graph representation of the adaptive pressure adjustment for pressure curve #3. Noting the height difference between the before and after bar charts demonstrates how bladders that are at higher pressures have pressures reduced proportionately more than those at lower pressures. The higher pressure bladders in curve#3 are reduced by a greater factor than those in curve#2. The end result for curve #3 is that all pressures are normalized after adaptation.

TABLE 4

| Pressure Curve #4: | |
|---|---|
| Bladder Pressure psi | Percentage Adjustment % of measure value |
| >1.50 | 30% |
| 1.3-1.50 | 30% |
| 1.1-1.29 | 50% |
| .90-1.09 | 70% |
| .70-.89 | 80% |
| .60-.69 | 80% |
| .50-.59 | 90% |
| <.50 | 100% |

Figure 25:
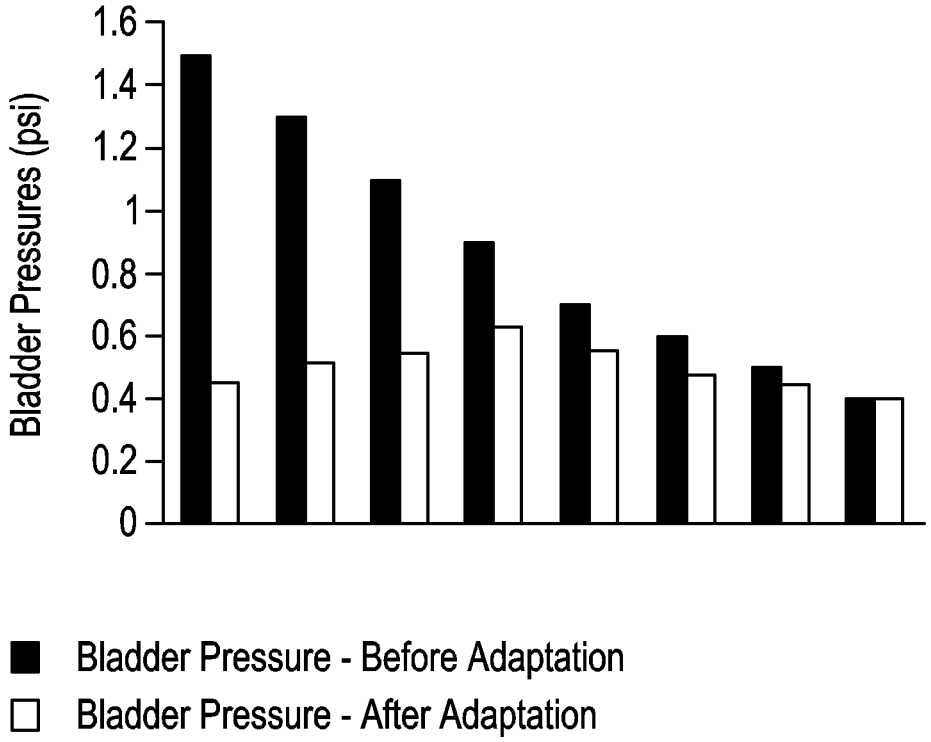
FIG. 25 is a bar graph representation of the adaptive pressure adjustment for pressure curve #4.

FIG. 25 is a bar graph representation of the adaptive pressure adjustment for pressure curve #4. Noting the height difference between the before and after bar charts demonstrates how bladders that are at higher pressures have pressures reduced proportionately more than those at lower pressures. However, unlike the pressure curves 1-3, the middle bladder pressure zones are not adjusted as much in the prior curves. The result provides an after adaptation bar graph with a hump in the middle pressure zone bladders. This represents a departure from the scheme of curves 1-3 and presents a different pressure adaptation path.

TABLE 5

| Pressure Curve #10: | |
|---|---|
| Bladder Pressure psi | Percentage Adjustment % of measure value |
| >1.50 | 70% |
| 1.3-1.50 | 75% |
| 1.1-1.29 | 80% |
| .90-1.09 | 85% |
| .70-.89 | 95% |
| <.70 | 100% |

Figure 26:
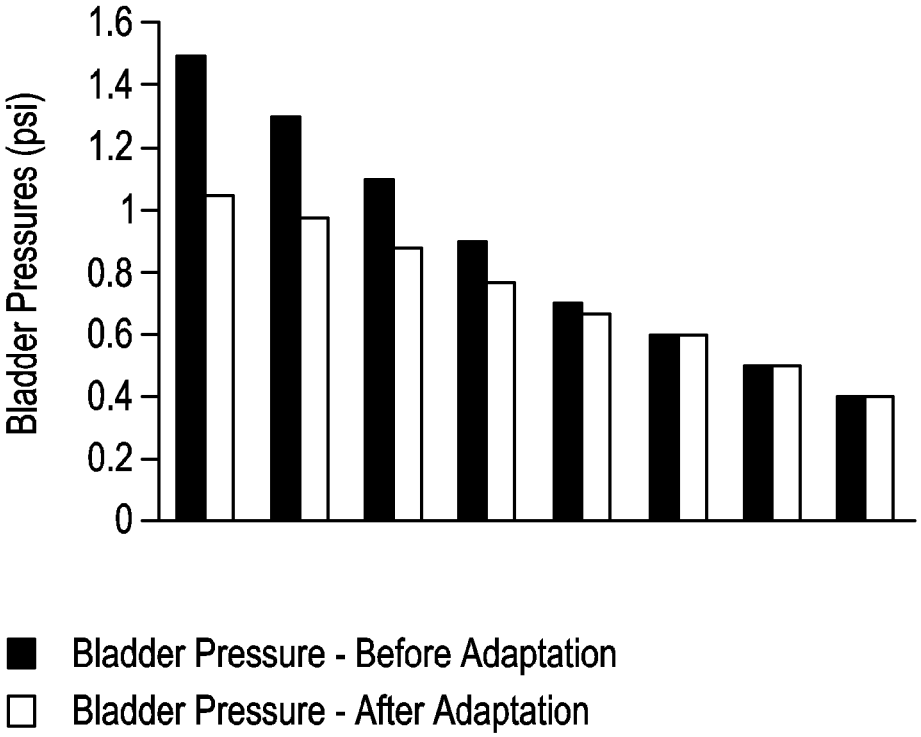
FIG. 26 is a bar graph representation of the adaptive pressure adjustment for pressure curve #10.

FIG. 26 is a bar graph representation of the adaptive pressure adjustment for pressure curve #10. Noting the height difference between the before and after bar charts demonstrates how the bladders that are at higher pressures have pressures reduced proportionately more than those at lower pressures. However, the pressure reduction based upon curve #10 maintains substantial pressure differences between high and low pressure bladders after adjustment. Unlike curve #3 above, the bladder pressures are not normalized after adaptation. This represents a departure from the scheme of curves 1-4 and presents a different pressure adaptation path.

If the SQN is less than or equal to about 4, 5 or 6, preferably 6, then an adaptive pressure adjustment may be made by choosing a different pressure profile curve than the current curve. The pressure profile curve determines the amount of adjustment that is made to a bladder given the magnitude of the individual bladder's pressure reading. For example, from the default pressure curve #1 above, a bladder having a pressure of 1.5 psi may be adjusted downwards to 50% of its value (0.75 psi), while a bladder showing a pressure of 1 psi may be adjusted downwards to 70% of its value (0.7 psi). Once a specific curve is used to adjust the actual bladder values, the TSMN is monitored over time.

After an adaptive pressure adjustment is made and a curve is applied to the bladders to adjust their pressures the TSMN, SMT, mintoss, majortoss, and poschange are reset to zero. OLDSQN is set equal to SQN (OLDSQN=SQN) to keep a record of the quality of sleep prior to the latest adaptive pressure adjustment.

Any bladder that experiences a pressure reading below the base pressure of about 0.40 psi may be inflated back to the base pressure of about 0.40 psi. A bladder may fall below the base point after a pressure being exerted on the bladder is removed from the bladder because air may have been removed during the adaptive phase. Once the pressure is ultimately removed from the bladder, air may be reinserted to increase pressure back to the base point pressure (about 0.40 psi).

SQN changes are monitored over the course of a sleep period. If SQN>OLDSQN then the adaptive sleep pressure adjustments are improving the quality of sleep for the individual. This further indicates that progress in the right direction towards a better individual pressure profile curve. As long as the SQN>OLDSQN, curves will be picked that move in the direction of this improvement. Conversely, if SQN<OLDSQN, then curves will be picked that go in a different direction from the prior ones chosen. For instance, if curve #1 was chosen and provided an improvement (SQN>OLDSQN), curve#2 was chosen and provided an improvement (SQN>OLDSQN), curve#3 was chosen and provided a negative improvement (SQN<OLDSQN), then curve #2 might be chosen again. If the improvement is still not at a target value, (target value is SQN>6), then another group of curves might be chosen that provides different ratio of bladder pressure to pressure reduction, in this case curves 4-10.

For a further refinement in determining the best possible individual pressure profile, it is also possible to superimpose a position profile curve on top of the pressure profile curve. A position profile curves adds bladder based pressure reductions based upon the individual's sleep orientation (sleeping on back, side, or front) as determined in step #9 above. For example, when an individual is on his or her back, bladders underlying the individual's gluteus maximus may need to be reduced by a greater factor than those underlying the shoulders. In this case the accompanying position profile curve may have a multiplication factor for bladders based upon their position underneath the sleeper. As an example, bladders that are determined to be under the gluteus maximus in this case may have a pressure reduction that is multiplied by 1.2 times. As a result, a bladder that was originally at 4 psi and was reduced 50% to 2 psi by the pressure profile curve, will after application of the position profile curve be reduced to a final pressure of 1.7 psi that is 42% (4*(0.5/1.2)) of its original value. Bladders that underlie the shoulders may have a pressure reduction that is multiplied by 1 and therefore remain unchanged from their pressure profile curve values. If after superimposing a position profile curve on top of the pressure profile curve, the SQN does not improve, the position profile curve may be removed. If the SQN increases, then the position profile curve may be used in addition to the adaptive pressure profile curves.

At some point, the SQN will not trend any lower. This might even occur if the SQN<=6. At this point, the associated pressure profile curve is identified as the best adaptive sleeper profile curve for this individual.

The SQN for an individual may be monitored into the future to determine if further adaptation and adjustment yields sleep quality improvement. At the same time, the individual's own subjective assessment of his or her sleep will influence the adaptive sleep algorithm adjustment. For example, if an individual indicates that he or she slept well regardless of the SQN number trending lower, that individual's profile curve may not be changed until further subjective assessment that asks for further profile curve improvement is provided.

Figure 19:
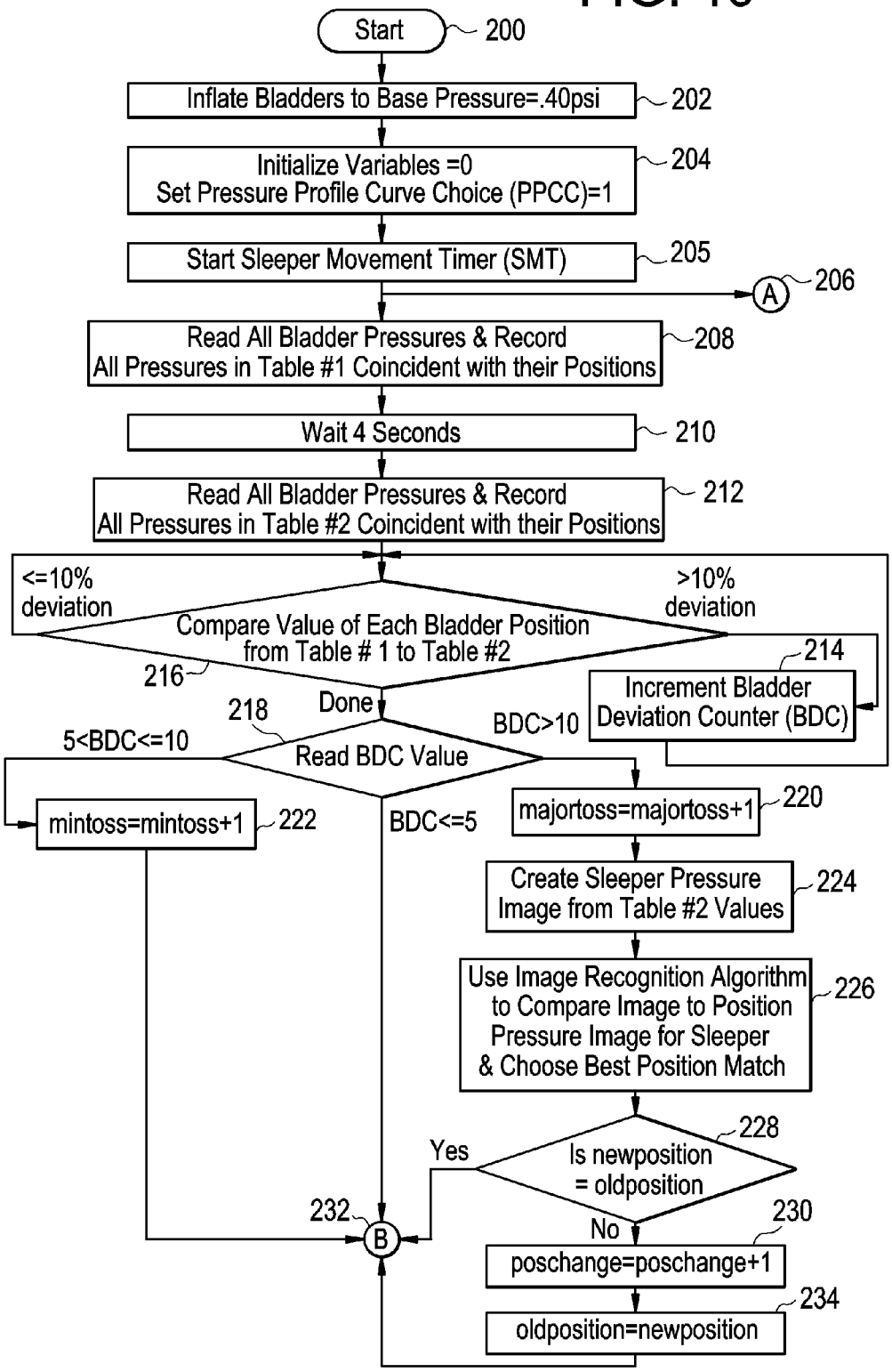
FIG. 19 is a flow diagram of a process that that optimizes a pressure contour of a pressure adjustable platform system.
Figure 20:
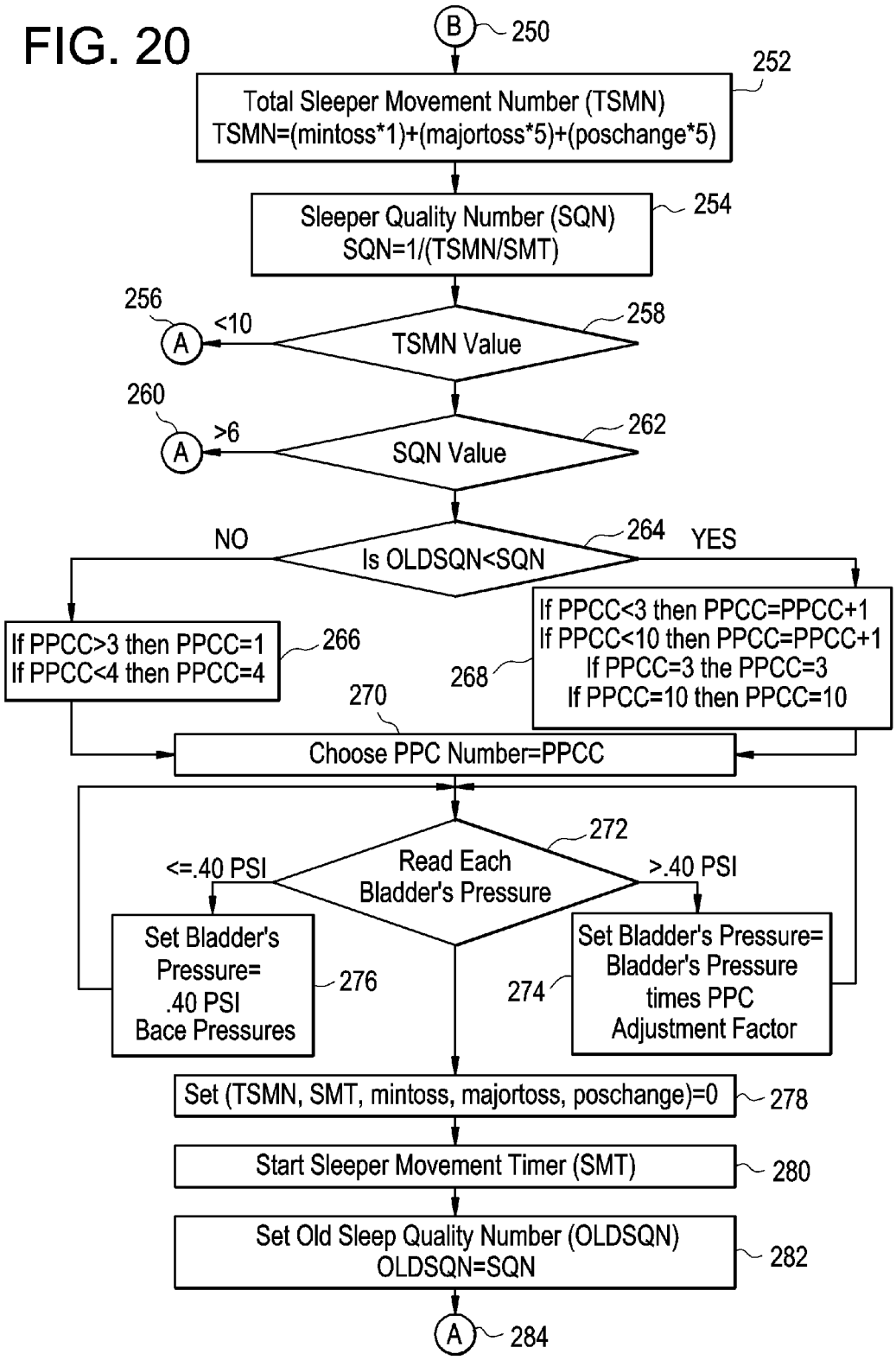
FIG. 20 is a continuation of the flow diagram in FIG. 19.
Figure 21:
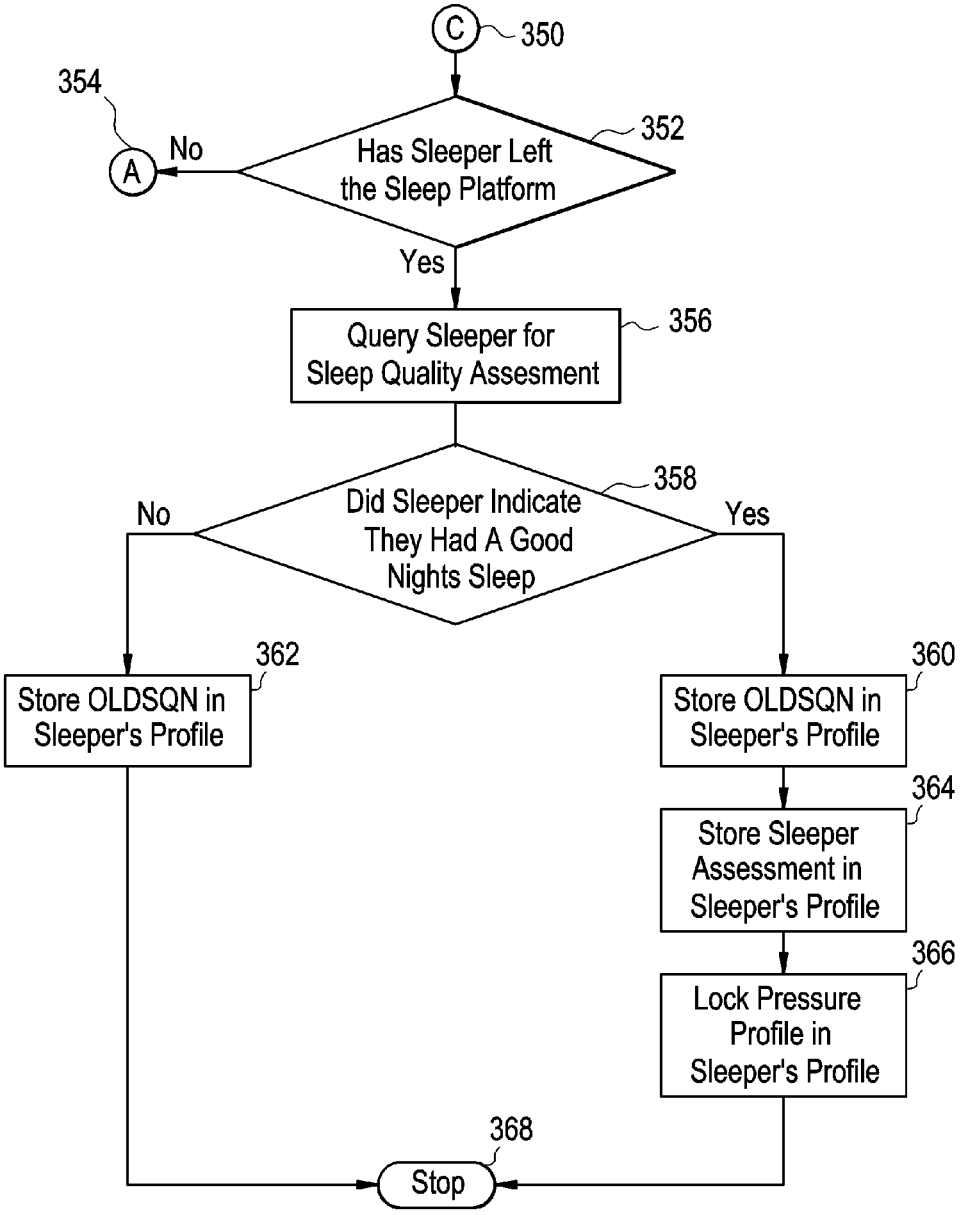
FIG. 21 is a continuation of the flow diagram in FIG. 20.

The methods may be understood with reference to the flow diagrams provided in FIGS. 19, 20 and 21 which depict exemplary embodiments. FIG. 19 is a flow diagram of a process that that optimizes a pressure contour of a pressure adjustable platform system. The process is started in step 200. Prior to a sleeper getting on the platform, all of the bladders are pressurized to 0.40 psi gauge pressure in step 202. All variables are initialized to zero values, and an initial pressure profile curve is chosen and set to curve #1 by default. This assumes that a stored known pressure profile for the sleeper does not exist. A sleeper movement timer (SMT) is started in step 205. This timer measures the elapsed time between adaptive pressure profile adjustments. All of the platform bladders pressures are read and stored in a table designated table 1 in step 208. The table may be a two dimensional table that provides an x and y label for each entry that corresponds to the bladder position on the platform. After a four second wait in step 210, the pressures of the platform bladders are read again and stored in a table designated table 2 in step 212. The same physical bladders on the platform occupy the same respective location in each of the two tables. Respective bladder readings are compared in step 216. If a deviation of greater than 10% exists between the two readings, indicating that a substantive pressure change for that bladder has occurred, then a Bladder Deviation Counter (BDC) is incremented in step 214. If the deviation is less than or equal to 10% the next bladder's values are compared. After all bladder readings in the two tables are compared, a BDC value is provided and read in step 218. If the BDC is equal to 5 or less, no significant movement is determined to have occurred on the pressure platform. The process then moves to step 232 that begins the next part of the process in FIG. 20. If a BDC value of greater than 5 and less than or equal to 10 is read, then a minor toss mintoss is said to have occurred in step 222. Mintoss is a counter that keeps track of the total number of minor tosses. After incrementing the mintoss counter the process progresses to step 232. If a BDC value of greater than 10 is recorded, then a major toss majortoss is said to have occurred in step 220. Majortoss is a counter that keeps track of the total number of major tosses. A sleeper pressure image is then created in step 224. This image is compared to known position pressure images for this sleeper, or in absence of such images, to a stock database of position pressure images in step 226. Once a best match position is determined, this position is compared to the last known position in step 228. If no position change has occurred, the process progresses to step 232. If a position change has occurred, a counter poschange is implemented in step 230. Poschange is a counter that keeps track of the total number of position changes. The last known position is set to the new position in step 234, and the process proceeds to step 232.

FIG. 20 is a continuation of the flow diagram in FIG. 19. The continuation of step 232 FIG. 19 continues in step 250. The Total Sleep Movement Number (TSMN) is calculated in step 252. The TSMN takes into account individual scale factors for minor and major moves as well as position changes. A Sleeper Quality Number (SQN) is calculated in step 254. The SQN includes SMT with the TSMN to determine a quantitative measurement of the sleep quality. The TSMN value is tested in step 258. If the value is less than 10, then the process returns via step 256 to step 206 FIG. 19. The SQN value is tested in step 262. If the value is greater than 6, then the process returns via step 260 to step 206 (FIG. 19). In both cases above, returning to step 206 (FIG. 19) is because the sleep quality is determined to be high and above a threshold that dictates that adaptive pressure adjustment is not required at this time. In step 264, the Old Sleeper Quality (OLDSQN) is compared to the SQN. If OLDSQN>SQN then a new pressure curve direction is taken in step 266 where the Pressure Profile Curve Counter (PPCC) is changed to point to a set of Pressure Profile Curves (PPC) that takes the adaptive algorithm in a new direction. If SQN>=OLDSQN, then the process continues within the current pressure profile curve direction and increment the PPCC in step 268 to point to the next curve within the current adaptive algorithm direction. After completing step 266 or 268, the new PPC is chosen from the new PPCC number in step 270. At step 272, each bladder's pressure on the platform is read. If the bladder pressure is less than or equal to the base point pressure of 0.40 psi, then that bladder is inflated to 0.40 psi in step 276. If the bladder pressure is greater than 0.40 psi then that bladder's pressure is set to a new pressure factoring in the PPC value for this bladder in step 274. Once all the bladders on the platform are read and adjusted, the variables are reset to zero in step 278. The SMT is restarted in step 280. OLDSQN is set equal to SQN in step 282 and the process continues on to step 300 (FIG. 21) in step 284.

FIG. 21 is a continuation of the flow diagram in FIG. 20. The continuation of step 284 FIG. 20 continues in step 350. Whether the sleeper has left the platform is determined in step 352. If the sleeper has not left the platform, then the process proceeds via step 354 to step 206 (FIG. 19). If the sleeper has left the platform, then the sleeper is questioned for a subjective sleep assessment in step 356. If the sleeper did not like the sleep experience, then the current OLDSQN is stored in their profile in step 362, and the adaptive algorithm is stopped in step 368. If the sleeper did like the sleep experience, then the current OLDSQN is stored in their profile in step 360. The sleeper's subjective sleep assessment is stored in their profile in step 364. Step 366 locks the sleeper profile so that no future adaptive correction will be implemented until the sleeper indicates a desire for better sleep. The adaptive algorithm is then stopped in step 368.

The methods are especially useful with a pressure adjustable platform system as described by Codos, "A Pressure Adjustable Platform System," U.S. patent application Ser. No. 61/675,496, filed Jul. 25, 2012, herein incorporated by reference. In such a pressure adjustable platform system, each bladder is individually sensed, regulated, and controlled via a central processing unit. Besides the known benefits of reducing pressure points on a sleeper that can result in improved sleep and health benefits, the platform system can be configured to sense and store sleep data that can be used for future pressure sleep profiles that improve the sleeper's quality of sleep.

Such a pressure adjustable platform system reduces the complexity of the fluid distribution and sensing network between the sleep support and a single apparatus that incorporates both the multi-port fluid sensing, as well as the multi-port fluid distributing functions, an example of which is Codos, "Fluid Sensing and Distributing Apparatus" (FSDA), U.S. patent application Ser. No. 61/675,901, filed Jul. 26, 2012, herein incorporated by reference. In some instances, the FSDA valve body is fastened directly into the sleep support base plate to eliminate any tubing interconnections between the sleep support and associated apparatus. This objective is achieved by matching the FSDA apparatus flat distribution plate on which the inlet and output ports are located to a matching port plate on the sleep support. Fluid connections are achieved by mating these two parts and using any one of known means for ensuring a leak-proof connection. In some instances, the distribution plate of the FSDA can be directly built into the sleep support base plate thereby serving effectively as a connection plate and thereby reducing the cost and complexity of the combined sleep support and associated apparatus. A further object of the invention is to affect or control a larger number of bladders that are proportional to larger sleep areas, without significantly increasing the fluid distribution and fluid sensing complexity and associated costs. By incorporating the fluid channels into the sleep support base plate, additional bladders are accompanied by additional corresponding fluid channels into the base plate without adding any additional fluid distribution components.

Such a pressure adjustable platform system reduces the number of components associated with sensing the pressure and displacement for each individual bladder. The requirement that pressure sensors subtend individual bladders or groups of bladders, or the need to provide a measuring sensor for each individual bladder increases the complexity and cost of a sleep system. The added complexity associated with the need for multiple pressure sensors and/or displacement transducers has the added effect of reducing the reliability of the sleep system. By providing a sensor that can be multiplexed to all of the sleep system bladders through an apparatus such as an FSDA apparatus, it is not necessary to provide a large number of sensors that subtend the bladders of the sleep support. An individual sensor may be multiplexed to read, for instance, about 25, 50, 100, 150 or so individual bladders. As a result, in some instances, three sensors may be used for sensing about 150 individual bladders on a sleep support. Bladders communicate with the multiplexed sensor through integrated fluid pathways.

Such a pressure adjustable platform system reduces the number of components required for inflating and deflating associated bladders. Providing an individual driver or actuator for each bladder or gang of bladders increases the complexity, cost, noise, size, and response time of a sleep system. The added complexity associated with the need for multiple actuators or drivers has the added effect of reducing the reliability of a sleep system. By utilizing an actuator that can be multiplexed to all of the sleep system bladders through an apparatus such as an FSDA apparatus, the need for a large number of actuators that communicate with each bladder for this invention is eliminated. An individual solenoid control valve may be multiplexed to fill and deflate approximately 25, 50, 100, or 150 or so individual bladders. As a result, three solenoid control valves that are used in conjunction with an FSDA apparatus are used for controlling for instance, about 150 individual bladders on the sleep support.

Such a pressure adjustable platform system eliminates wiring between the bladders and the force sensors. At the same time, the wiring for the actuators needed to increase and decrease pressure to the individual bladders is also eliminated. Instead of wiring, bladders communicate with the multiplexed actuators and sensors through the integrated fluid pathways. A single fluid channel connects each bladder to the external fluid sensing and distributing apparatus and is the only conduit needed for sensing pressure in the bladder, providing fluid and exhausting fluid to the bladder.

Such a pressure adjustable platform system provides a bladder that combines the characteristics of an extendable cylinder with the characteristics of an expandable bladder. An extendable and retractable cylinder maintains a constant internal pressure value regardless of its amount of extension for a given loaded mass. When subjected to a constant external load, an extendable and retractable cylinder transmits a force through a fluid channel connected to the cylinder that is proportional to the applied load. Reducing air in the cylinder only reduces the height of the cylinder without reducing the internal pressure. By contrast, when an expandable bladder is subjected to a constant external load, the bladder deforms in shape while transmitting only a small portion of the applied force through a fluid channel connected to the bladder. It is desirable to utilize a fluid coupled remote sensor to measure the force on a bladder in response to an applied load. A retractable cylinder style bladder achieves this result. It is also desirable to create a bladder that deforms so that it contacts adjoining bladders. This inter-bladder contact helps transfer loads to adjoining bladders while increasing lateral stability and decreasing lateral movement of the sleeper. An expandable bladder accomplishes this goal. It is therefore an object of this invention to combine these two bladder types into a single hybrid bladder.

Such a pressure adjustable platform system provides a sleep support composed of bladders in which each bladder is individually sensed, regulated, and controlled via a central processing unit. Besides the known benefits of reducing pressure points on a sleeper that can result in improved sleep and health benefits, the sleep system can be configured to sense and store sleep data that can be used for future pressure sleep profiles that improve the sleeper's quality of sleep.

FIG. 1 depicts such a pressure adjustable platform system 10 that includes a top cover 12. The cover 12 may be made of a knitted material, cotton, polyester fibers, or a woven or needle punched fabric, and the cover 12 may be quilted or not quilted. Below the cover 12 is a layer of foam padding 14. The foam padding 14 may be a polyurethane foam of medium density. Below the foam padding 14 is a sisal layer 16. A variety of other padding materials, other combinations of padding and insulating materials, and various cover materials and constructions may be used.

Below the padding 14 and cover 12 materials are provided hybrid pneumatic bladders with sidewalls 30 that are encased in a mesh 31 on the bottom portion of the bladder. The mesh 31 restricts a portion of the bladder from expanding outward by some limit when subjected to increasing internal air pressures. At the same time, the mesh 31 allows the same portion of the bladder to collapse upon itself. As a result, this portion of the bladder transmits forces through a fluid conduit back to a pressure sensor when subjected to external loads. This may be similar to the manner in which a rigid wall pneumatic cylinder transmits forces through a fluid conduit when subjected to an external load.

The bladders are located on a base plate 24 that has recessed slots that correspond to the individual bladder positions. The individual bladders may be replaced by a group of bladders that are attached to one another by an integral bladder base membrane. This multiple bladder sheet may be molded as a single piece with the added benefit of reducing manufacturing costs associated with individual bladder construction. The base plate 24 may have recessed slots corresponding to the multiple bladder configurations. The bladder may have any suitable diameter allowing for an increased or decreased number of bladders for a given mattress size. The end result of a greater number of bladders is a mattress having a larger number of sense and control points therefore decreasing the granularity of the sense and react function and increasing the control over the sleep area.

The bladders may be secured to the base plate 24 by a bladder top plate 18, which clamps the bladder to the base plate 24 by clamping the bladders' flange to the base plate 24. The entire bladder assembly rests on a box top plate 22. The box top plate 22 serves to seal the fluid conduits that are part of the lower side of the base plate 24, as well as provide structural support for the entire bladder assembly. The box top plate 22 forms the top surface of the box assembly 20, which provides structural support for the entire sense, react, and adapt sleep apparatus, along with the associated sleepers.

Figure 2A:
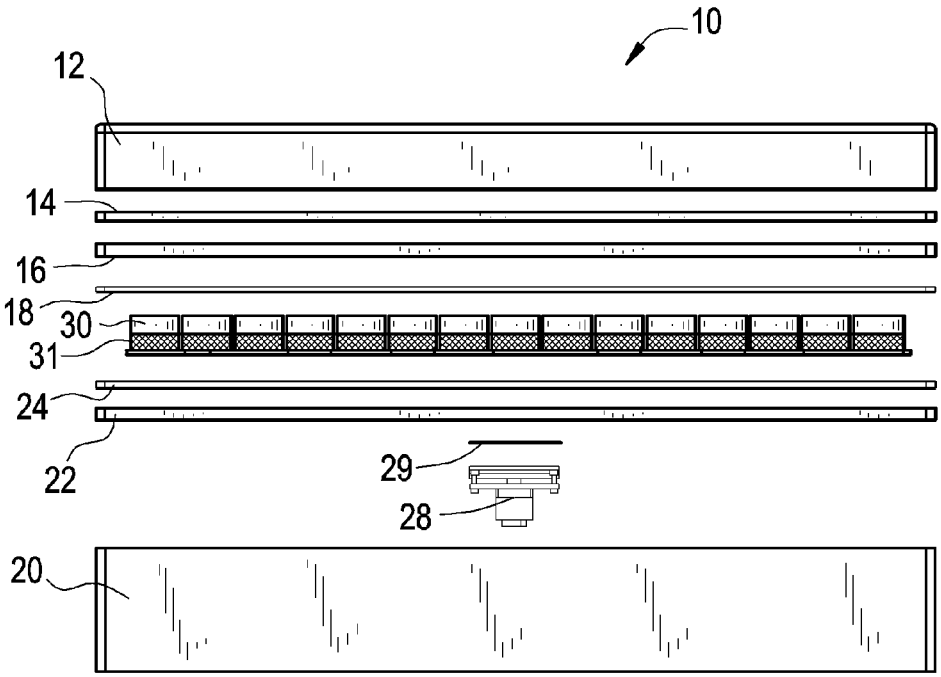
FIG. 2A is an exploded front view of the sense, react, and adapt sleep apparatus of FIG. 1.
Figure 2B:
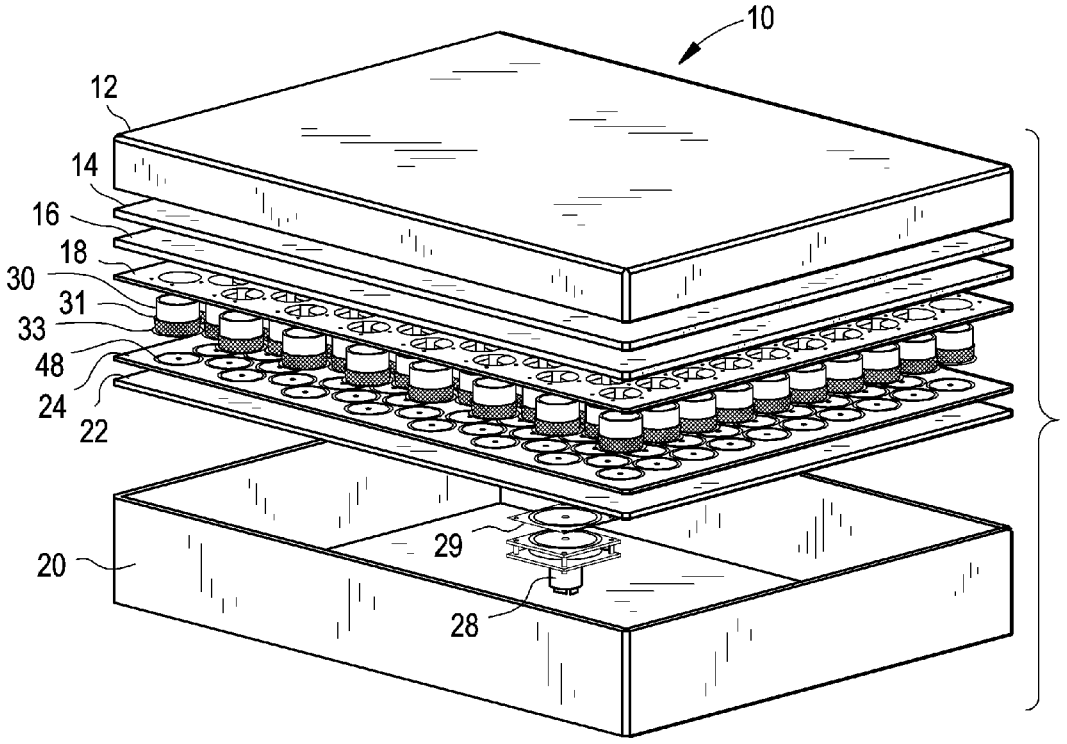
FIG. 2B is an exploded top perspective view of the sense, react, and adapt sleep apparatus of FIG. 1.
Figure 2C:
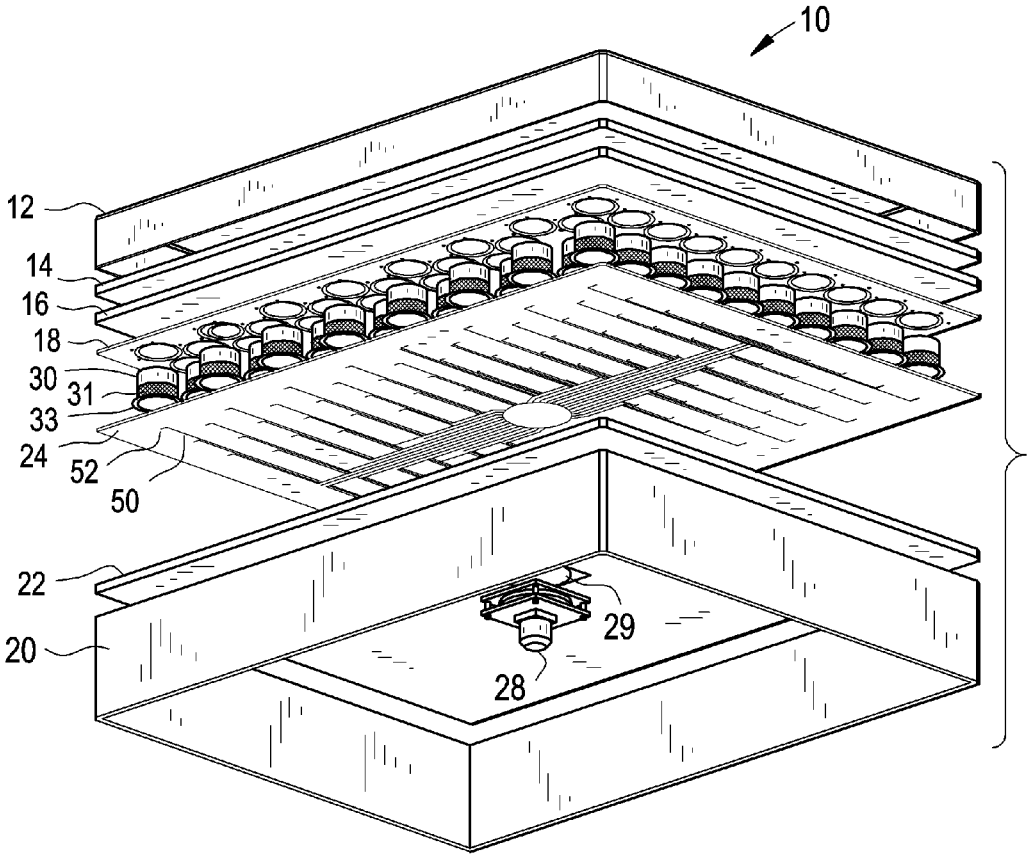
FIG. 2C is an exploded bottom perspective view of the sense, react, and adapt sleep apparatus of FIG. 1.

FIG. 2A provides a front expanded view of such a pressure adjustable platform system 10 of FIG. 1. In addition to those components visible in FIG. 1 is also a fluid sensing and distributing apparatus 28 described in Codos, "A Fluid Sensing and Distributing Apparatus," U.S. patent application 61/675,901, filed Jul. 26, 2012, hereby incorporated by reference. The fluid sensing and distributing apparatus 28 is fastened directly to the base plate 24 through a matching gasket plate 29. This direct connection of the fluid sensing and distributing apparatus 28 to the base plate 24 through the gasket plate 29 eliminates any tubing interconnections. The distribution plate of the fluid sensing and distributing apparatus 28 can be directly built into the base plate 24 thereby eliminating the need for a gasket plate 29. FIG. 2B provides an expanded top perspective view of FIG. 1. The bladder top plate 18 clamps the bladders to the base plate 24 by clamping the flange 33 on the bladder into the bladder locating slot 48 that is recessed into the base plate 24. FIG. 2C provides an expanded bottom perspective view of FIG. 1. Visible in this view is the bottom side of base plate 24 revealing the fluid channels 50 that convey fluid between the bladders and the fluid sensing and distributing apparatus 28.

Figure 3A:
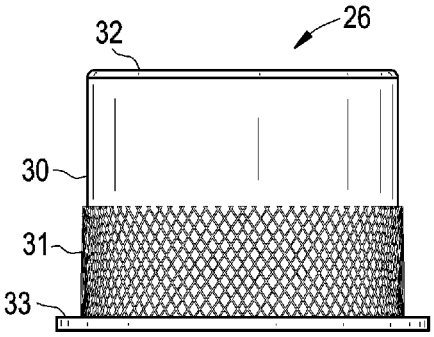
FIG. 3A is a front view of one embodiment of a hybrid bladder utilizing a mesh on the bottom section.

FIG. 3A is a front view of the bladder 26 and mesh 31 described herein. The bladder may be made from a silicon rubber compound with a shore A hardness of for instance, about 10A, 20A, 30A, 40A, 50A, etc. The bladder wall thickness may be about 0.05, 0.1, 0.2, 0.25, 0.3, 0.5 or so inches, with about a 2.0, 3.0, 4.0, 4.5, 4.75, 5.0 or 6.0 inch diameter and about a 2.0, 3.0, 3.5, 4.0 or 5.0 inch height. The mesh may be made from a polyethylene plastic material approximately 1/16 inch in thickness. The mesh height may extend about 1.0, 1.25, or 1.50 or so inches from the top of the flange 33. The bladder's sidewall 30 is in its non-inflated state. This non-inflated state is defined as having an internal pressure in the bladder equal to, or less than, the external atmospheric pressure that is exerted upon the bladder. Bladder flange 33, which may be about 0.25, 0.3, 0.4, 0.5, 0.6, 0.7, 0.8 or so inches wide and about 0.1, 0.2, 0.3, 0.4 or so inches thick, is an integral part of the bladder as is used to clamp the bladder to base plate 24 (FIG. 2A) thru the clamping action of bladder top plate 18 (FIG. 2A) as the top plate is mechanically connected, using any one of known means, to base plate 24 (FIG. 2A). These mechanical connection means may be, for instance, screw fasteners, clamp fasteners, or plastic welding of the two plates. Once the bladder flange 33 is clamped to the base plate 24 (FIG. 2A), it forms a fluid tight seal between the internal cavity 35 (FIG. 3C) of bladder 26 and base plate 24 (FIG. 2A).

Figure 3B:
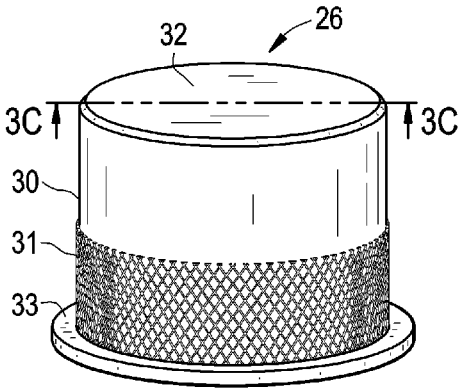
FIG. 3B is a perspective view of the bladder in FIG. 3A.
Figure 3C:
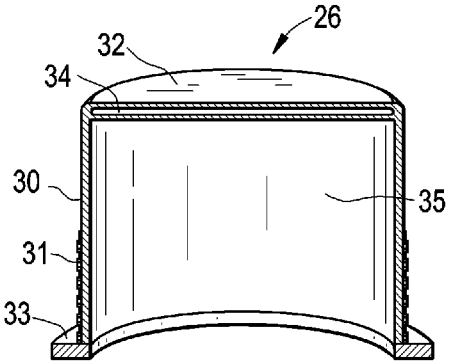
FIG. 3C is a cross-sectional perspective view on line A-A of FIG. 3A.

FIG. 3B is a front perspective view of the bladder 26 showing line A-A. FIG. 3C is a cross-sectional perspective view on line A-A of FIG. 3B. A plastic insert 34 is provided to insure that the top surface 32 of the bladder is maintained in a flat orientation that is parallel to the bladder flange 33 when the bladder 26 is in its non-inflated state, or when the bladder is subjected to an internal fluid pressure that exceeds the external atmospheric pressure (inflated state). Maintaining the top surface 32 of the bladder parallel to the bladder flange 33 insures that forces exerted on an individual are distributed across the entire area of top surface 32. This insures that pressure points that could otherwise arise from a bulging upper bladder surface are not transmitted through to the individual. The plastic insert 34 may be made from, for instance, an Acetal Resin plastic that may be about 3/32" thick. It may also be made from, for example, acrylonitrile butadiene styrene plastic, nylon, polyvinyl chloride, or any plastic that is compatible with the silicon rubber of bladder 26 and stiff enough so as to not significantly deflect when subjected to the loaded internal pressures of the bladder. Internal cavity 35 is visible in this view.

Figure 3D:
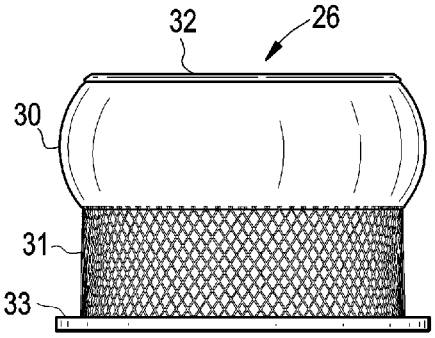
FIG. 3D is a front view of the bladder in FIG. 3 shown in an inflated form due to fluid inflation.

FIG. 3D is a front view of the bladder in FIG. 3A shown in an inflated state due to increased internal fluid pressure. The internal fluid pressure is greater than the external atmospheric pressure causing the bladder's sidewall 30 to bulge outward. An increased internal fluid pressure can be the result of an external load applied to top surface 32, or can be the result of the cpu, via the fluid sensing and distributing apparatus 28, directing a higher fluid pressure into the respective bladder 26. The mesh 31 provides the area that it encircles, with resistance to tangential forces that result from the internal cavity 35 (FIG. 3C) having an internal fluid pressure greater than the external atmospheric pressure. When the bladder is in an inflated state due to increased internal fluid pressure, mesh 31 underlining the portion of sidewall 30 maintains a perpendicular orientation to flange 33. When top surface 32 is subjected to external forces, side wall 30 above the mesh bulges outward in direct response to rising internal fluid pressures in the internal cavity 35 (FIG. 3C). At the same time, top surface 32 moves closer to flange 33 while remaining substantially parallel to flange 33. At some loaded pressure, the portion of side wall 30 that lies under the mesh 31 begins to buckle upon itself allowing upper surface 32 to further collapse towards flange 33 without additional bulging of sidewall 30 that lies above the mesh 31. This buckling action transmits pressure forces, above atmospheric pressure and commensurate with the external force pressure, through a fluid conduit back to a pressure sensor.

Figure 4A:
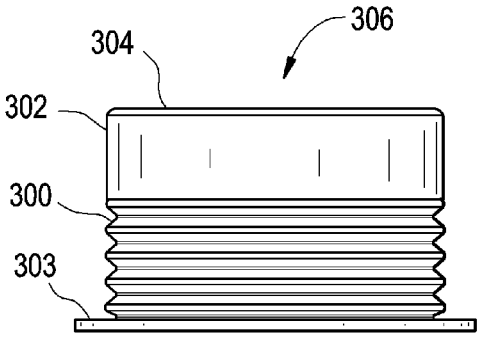
FIG. 4A is a front view of one embodiment of a hybrid bladder composed of a bellows bottom section.

FIG. 4A is a front view of an alternative bladder 306 having a bellows bottom section 300. The bladder functions similar to the bladder 26 of FIG. 3A but does not have the mesh 31 of the bladder 26 of FIG. 3A. Instead of a mesh to constrain the bladder sidewall, a bellows bottom section 300 collapses upon itself when the bladder 306 is subjected to an external force threshold level through a top plate 304. The bladder may be made, for instance, from a silicon rubber compound with a shore A hardness of, for instance, 10A, 20A, 30A, 40A, 50A, etc. The bladder wall thickness may be about 0.05, 0.1, 0.2, 0.25, 0.3, 0.5 or so inches, with about a 2.0, 3.0, 4.0, 4.5, 4.75, 5.0 or 6.0 inch diameter and about a 2.0, 3.0, 3.5, 4.0 or 5.0 inch height. The bellows 300 is configured such that adjacent corrugated folds are at approximately 90 degrees to one another and plus or minus 45 degrees from vertical, the vertical plane being coincident with sidewall 302 and perpendicular to flange 303. The bellows height extends about, for instance, 1.25 inches from the top of the flange 303. The bladder's sidewall 302 is in its previously defined non-inflated state. Bladder flange 303, which may be about 0.25, 0.3, 0.4, 0.5, 0.6, 0.7, 0.8 or so inches wide and about 0.1, 0.2, 0.3, 0.4 or so inches thick, is an integral part of the bladder that is used to clamp the bladder to the base plate 24 (FIG. 2A) through the clamping action of bladder top plate 18 (FIG. 2A) as the top plate is mechanically connected, using any one of known means, to the base plate 24 (FIG. 2A). In another configuration the angular relationship of the corrugated folds to one another can be other than 90 degrees.

Figure 4B:
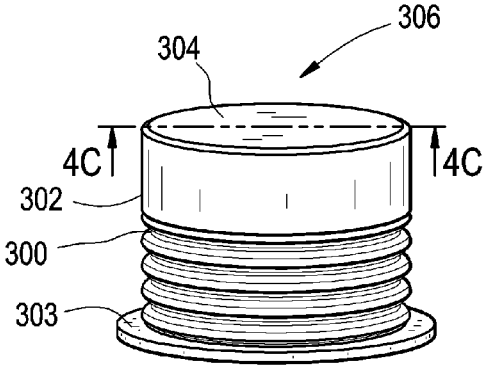
FIG. 4B is a perspective view of the bladder in FIG. 4A.

FIG. 4B is a front perspective view of the bladder in FIG. 4A. A cut line A-A is shown.

Figure 4C:
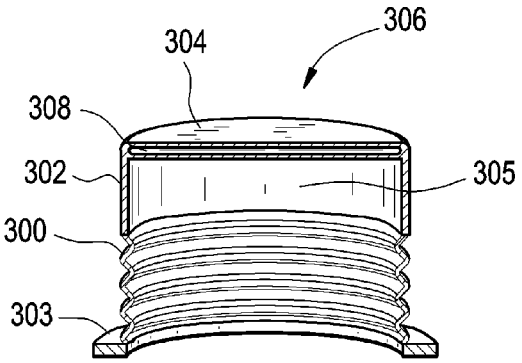
FIG. 4C is a cross-sectional perspective view on line A-A of FIG. 4B.

FIG. 4C is a cross-sectional perspective view on line A-A of FIG. 4B. Plastic insert 308 is provided to insure that the top surface 304 of the bladder is maintained in a flat orientation that is parallel to the bladder flange 303 when the bladder 306 is in its non-inflated state, or when the bladder is subjected to an internal fluid pressure that exceeds the external atmospheric pressure (inflated state). Maintaining the top surface 304 of the bladder parallel to the bladder flange 303 insures that forces exerted on the sleeper are distributed across the entire area of top surface 304. This insures that pressure points that could otherwise arise from a bulging upper bladder surface are not transmitted through to a sleeper. Plastic insert 308 may be made from an Acetal Resin plastic and about, for instance, 3/32" thick. The plastic insert 308 may also be formed of acrylonitrile butadiene styrene plastic, nylon, polyvinyl chloride, or any plastic that is compatible with the bladder 306 and stiff enough to not significantly deflect when subjected to the loaded internal pressures of the bladder. Internal cavity 305 is visible.

Figure 4D:
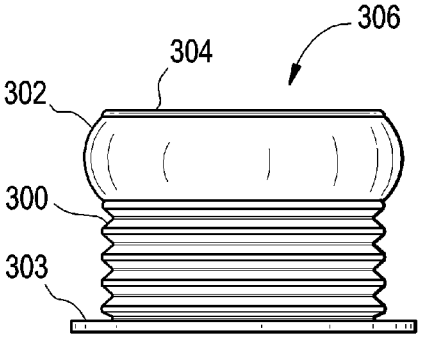
FIG. 4D is a front view of the bladder in FIG. 4A shown in an inflated form due to fluid inflation.

FIG. 4D is a front view of the bladder in FIG. 4A shown in an inflated state due to increased internal fluid pressure. The internal fluid pressure is greater than the external atmospheric pressure causing the bladder's sidewall 302 to bulge outward. An increased internal fluid pressure can be the result of an external load applied to top surface 304, or can be the result of cpu via a fluid sensing and distributing apparatus 28, directing a higher fluid pressure into the respective bladder. The bellows 300 provides that the distance, for instance, 1.00, or 1.25 or 1.50 or so inches, as measured from the top of the flange 303, with resistance to tangential forces that results from the internal cavity 305 (FIG. 4C) having an internal fluid pressure greater than the external atmospheric pressure. When the bladder is in an inflated state due to increased internal fluid pressure, bellows 300 maintains a perpendicular orientation to flange 303. When top surface 304 is subjected to external forces, side wall 302 bulges outward in response to rising internal fluid pressures in the internal cavity 305 (FIG. 4C). At the same time, top surface 304 moves closer to flange 303 while remaining substantially parallel to flange 303. At some loaded pressure, bellows 300 starts to collapse allowing upper surface 304 to further collapse towards flange 303 without additional bulging of sidewall 302. This buckling action transmits pressure forces, above atmospheric pressure and commensurate with the external force pressure, through a fluid conduit back to a pressure sensor such as a pressure sensor present in a fluid sensing and distributing apparatus 28.

Figure 5:
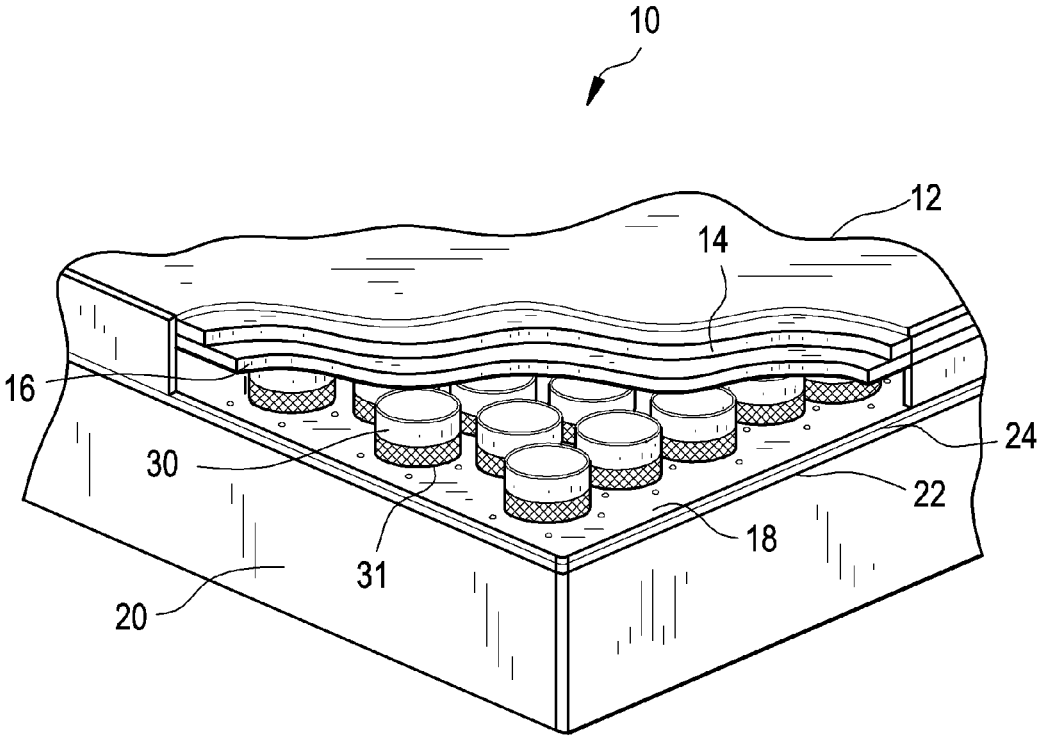
FIG. 5 is a close-up of the cutaway section of FIG. 1 showing the bladders in a non-inflated state.

FIG. 5 is a close-up of the cutaway section of FIG. 1 showing the bladders in a non-inflated state. This non-inflated state is defined as having an internal pressure in the bladder equal to, or less than, the external atmospheric pressure that is exerted upon the bladder. The bladder 26 represented in FIG. 1, and this view, is the bladder 26 with mesh represented in FIG. 3A. The bladder's sidewall 30 is substantially perpendicular to the bladder top plate 18. When the bladders 26 are in a non-inflated state an air gap exists between adjacent bladders 26. The air gap may be, for instance, about ¾ inch, 1 inch, or 1¼ inch or so as measured between adjacent bladder's sidewalls 30. Each bladder's sidewall 30 is in a parallel orientation to the adjacent bladder's sidewall 30.

Figure 6:
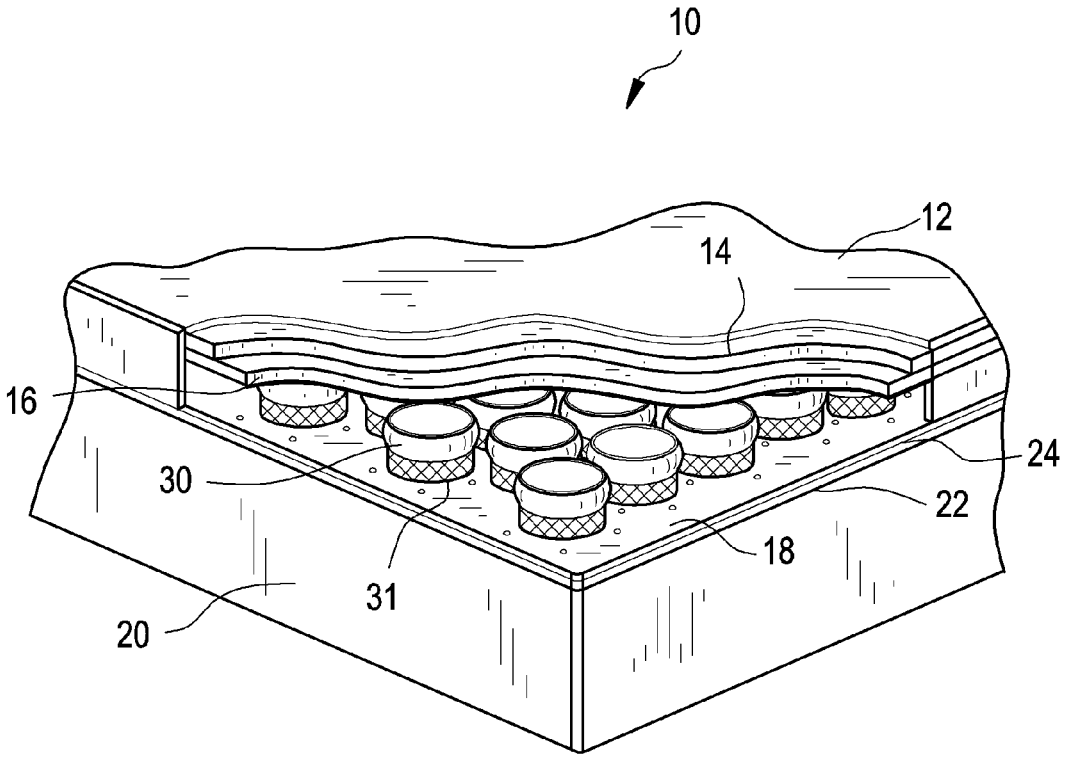
FIG. 6 is a close-up of the cutaway section of FIG. 1 showing the bladders in an inflated state.

FIG. 6 is a close-up of the cutaway section of FIG. 1 showing the bladders in an inflated state. This inflated state is defined as having an internal pressure in the bladder greater than the external atmospheric pressure that is exerted upon the bladder. When the bladders 26 are in an inflated state, the bladder's sidewall 30 bulges outward in a direction parallel to the plane of bladder top plate 18, and tangential to the original sidewall 30 orientation shown in FIG. 5. As the internal pressure in the bladder increases, the extent of the bulge also increases resulting in a decreased air gap between adjacent bladder sidewalls 30. The air gap continues to decrease as the internal pressure increases up to the point where sidewall 30 comes into contact with an adjacent bladder's sidewall 30. At this point the bladder sidewall 30 may continue to expand in an asymmetric manner as it continues to expand in areas not constrained by adjacent bladder sidewalls. One of the effects of having the bladder's sidewall 30 in contact with an adjacent bladder's sidewall 30 is to provide lateral support to the bladder. An additional effect is that some external forces acting upon a bladder are partially transferred to adjacent bladders.

Figure 7:
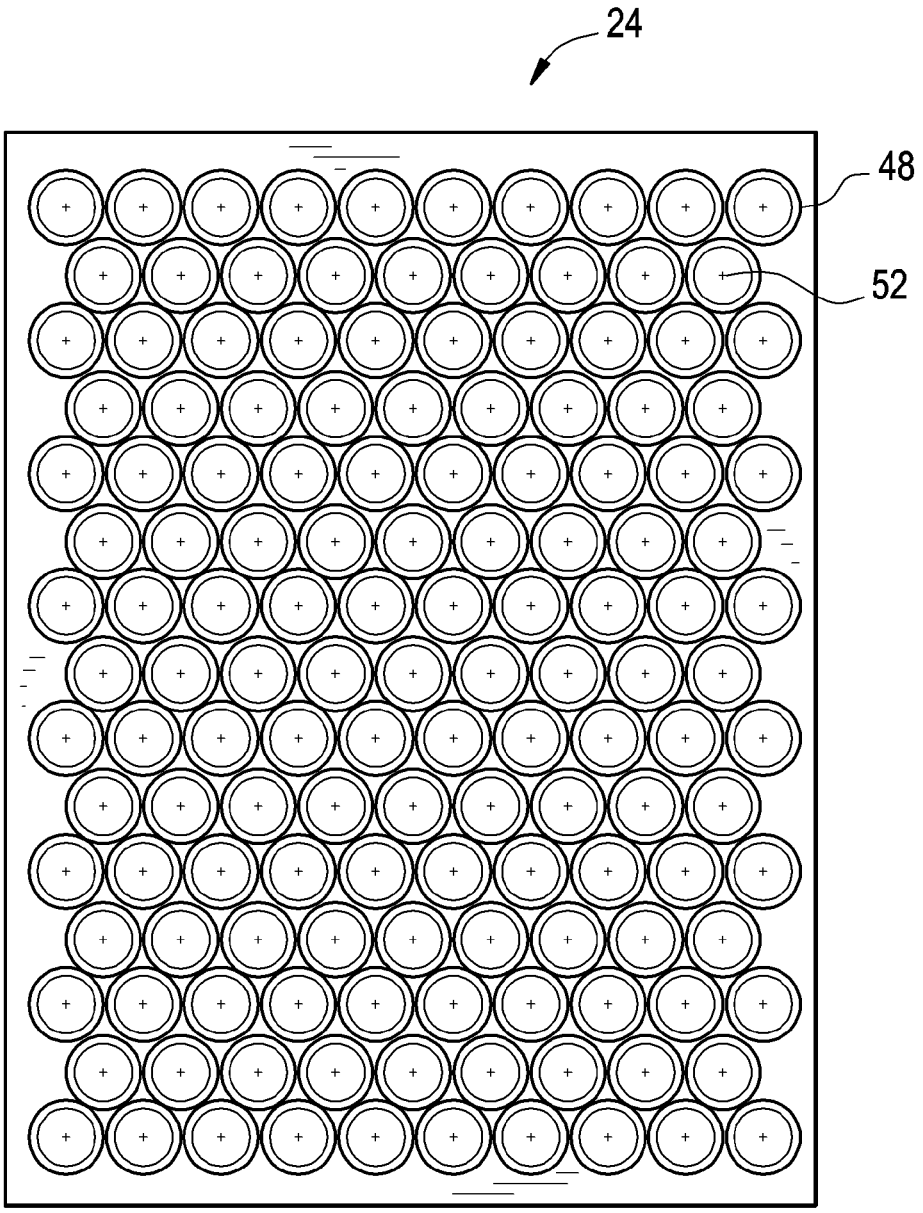
FIG. 7 is a top view showing the bladder base plate showing the bladder rim recess channels.

FIG. 7 is a top view of the bladder base plate 24 with the bladder rim recess channels 48 visible. Bladder fill port 52 is visible in the center portion of each bladder location. Bladder rim channel 48 is used to locate the individual bladders as well as provide a recessed channel into which bladder flange 33 (FIG. 3A) fits. The channels may be, for instance 0.05, 0.1, 0.2, 0.3 or so inches deep with a width of, for instance, about 0.25, 0.3, 0.4, 0.5, 0.51, 0.6, 0.7 or so inches.

Figure 8A:
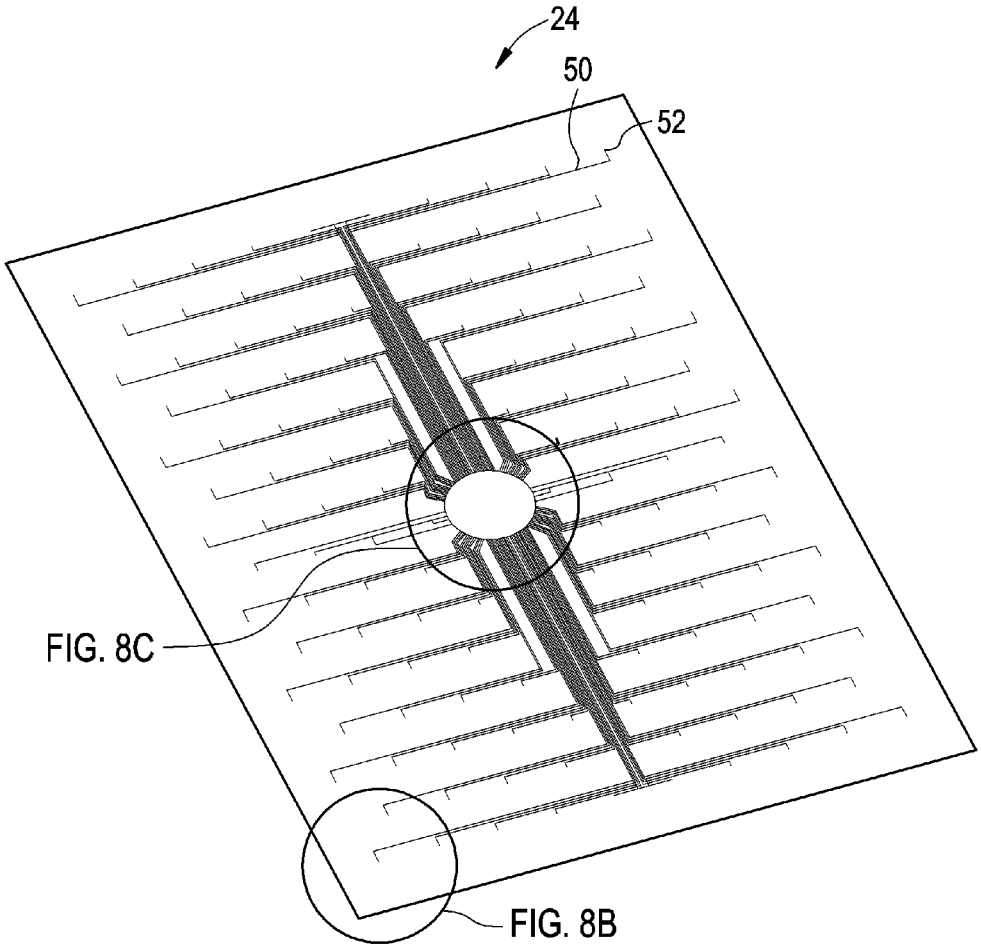
FIG. 8A is a perspective bottom view of the bladder base plate showing the sense and supply channels.

FIG. 8A is a perspective bottom view of the bladder base plate 24. FIG. 8C indicates where the fluid sensing and distributing apparatus 28 (FIG. 2A) is connected directly into the base plate 24 through gasket plate 29 (FIG. 2) eliminating any tubing interconnections with the fluid sensing and distributing apparatus 28 (FIG. 2A). The fluid channels 50 convey fluids between the fluid sensing and distributing apparatus 28 (FIG. 2A) and the bladders 26 (FIG. 3A).

Figure 8B:
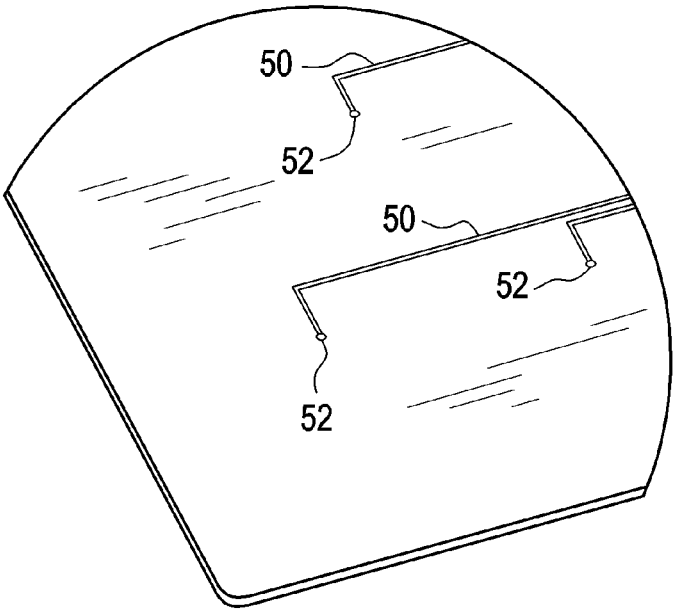
FIG. 8B is an enlarged view from FIG. 8A showing the sense and supply channels for individual bladders.
Figure 8C:
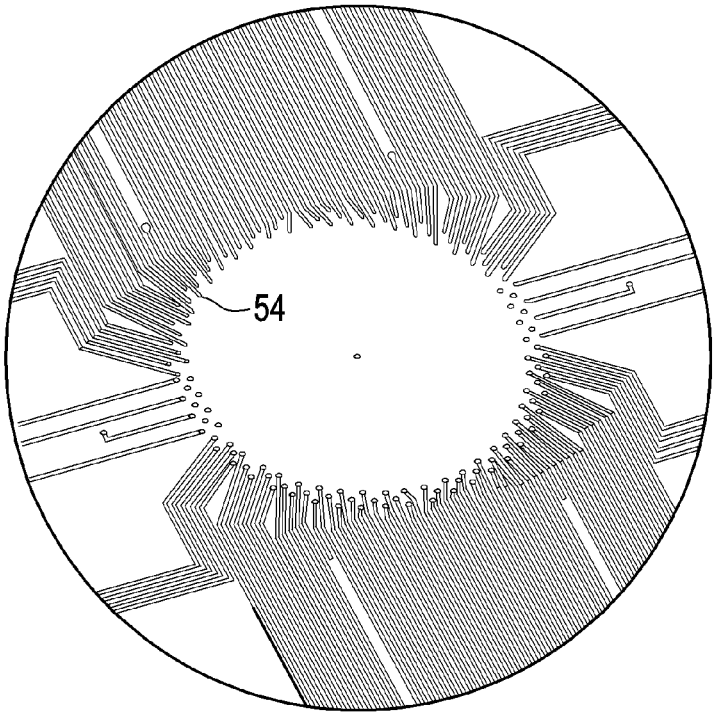
FIG. 8C is an enlarged view from FIG. 8 showing the sense and supply channels that terminate at the interface plate for the FASB sensing and distribution ports.
Figure 9:
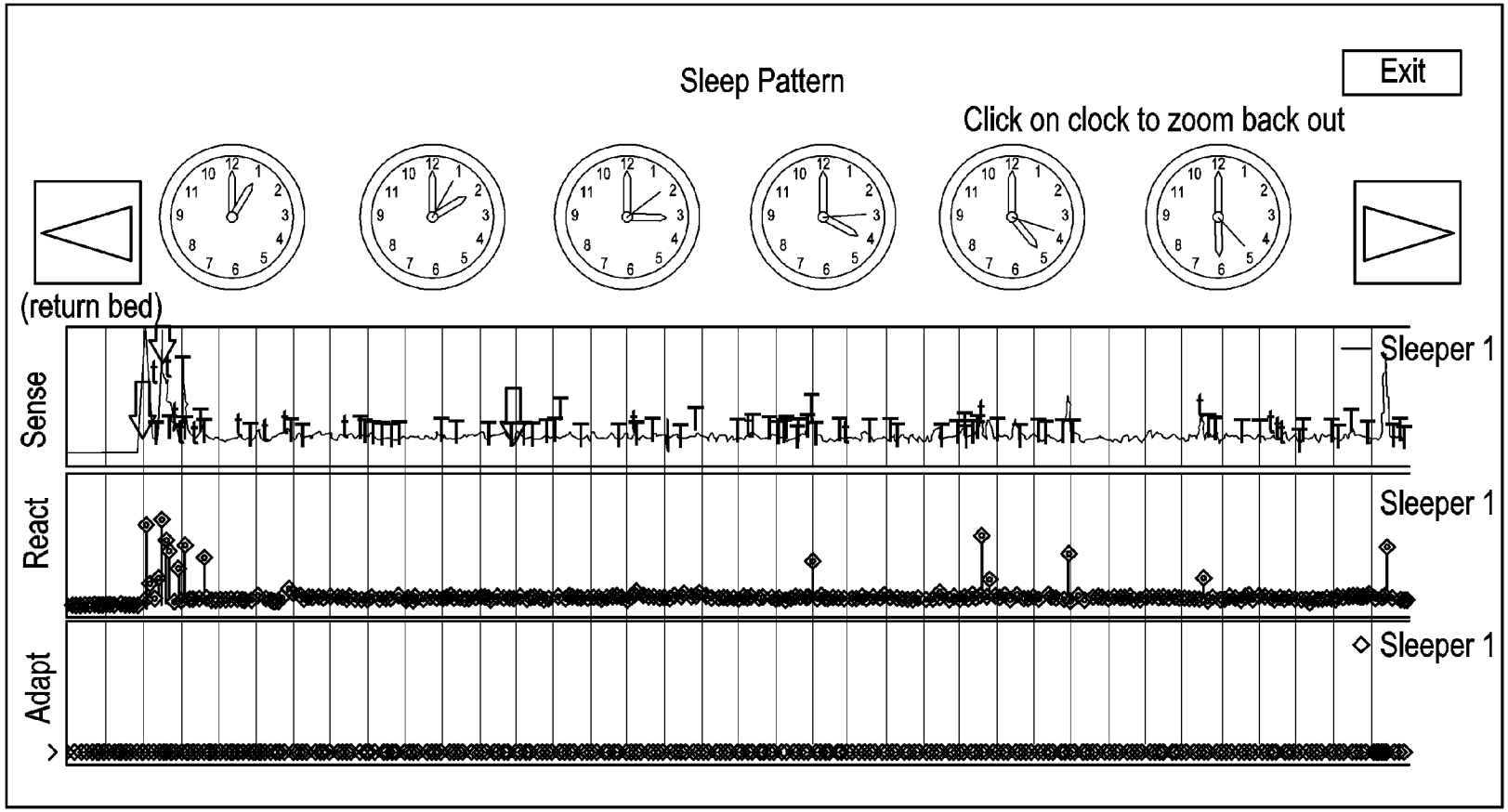
FIG. 9 is a documented image of a subject sleeping on an adjustable platform system providing an observed pattern with 6 hours of sleep, as shown by the top row of clocks, with each hour broken up into 10 minute time bands. A small "t" indicates a minor toss while a big "T" indicates a major toss. Position changes are indicated by bar movements in the React band.
Figure 10:
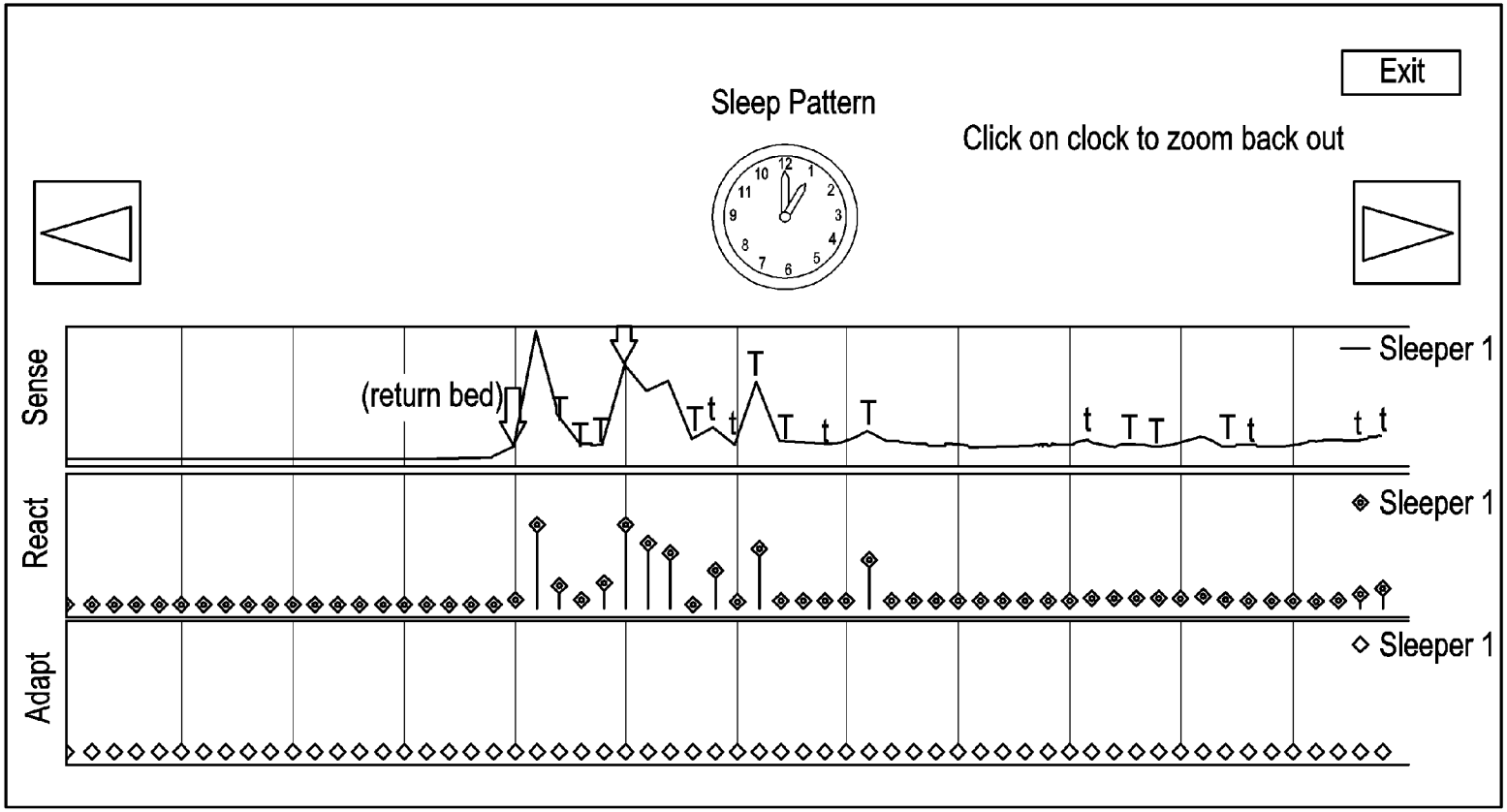
FIG. 10 is a documented image of a subject sleeping on an adjustable platform system providing an observed pattern, with each hour broken up into 5 minute time bands. A small "t" indicates a minor toss while a big "T" indicates a major toss. Position changes are indicated by bar movements in the React band.
Figure 11:
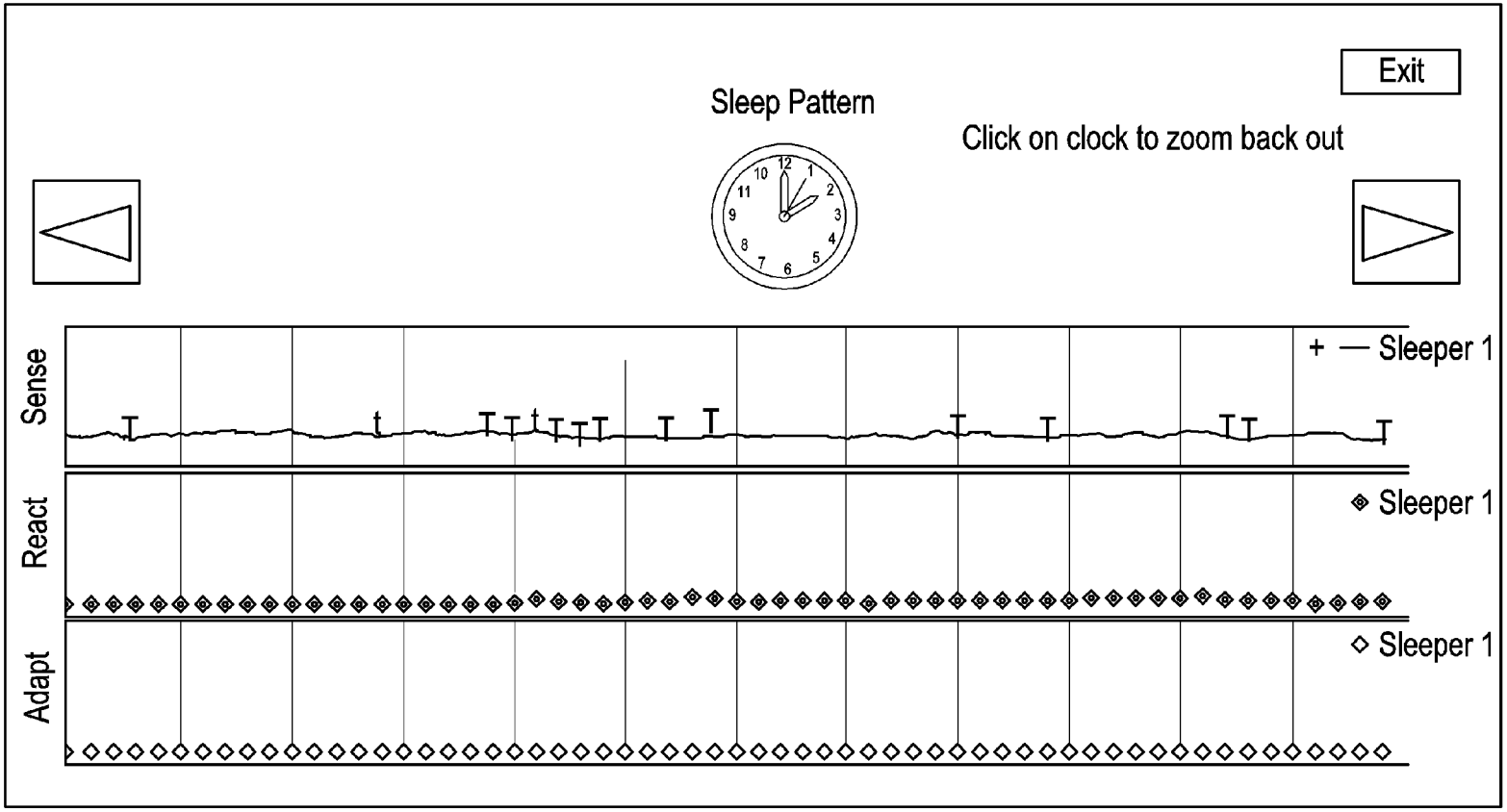
FIG. 11 is another documented image of a subject sleeping on an adjustable platform system providing an observed pattern, with each hour broken up into 5 minute time bands. A small "t" indicates a minor toss while a big "T" indicates a major toss. Position changes are indicated by bar movements in the React band.
Figure 12:
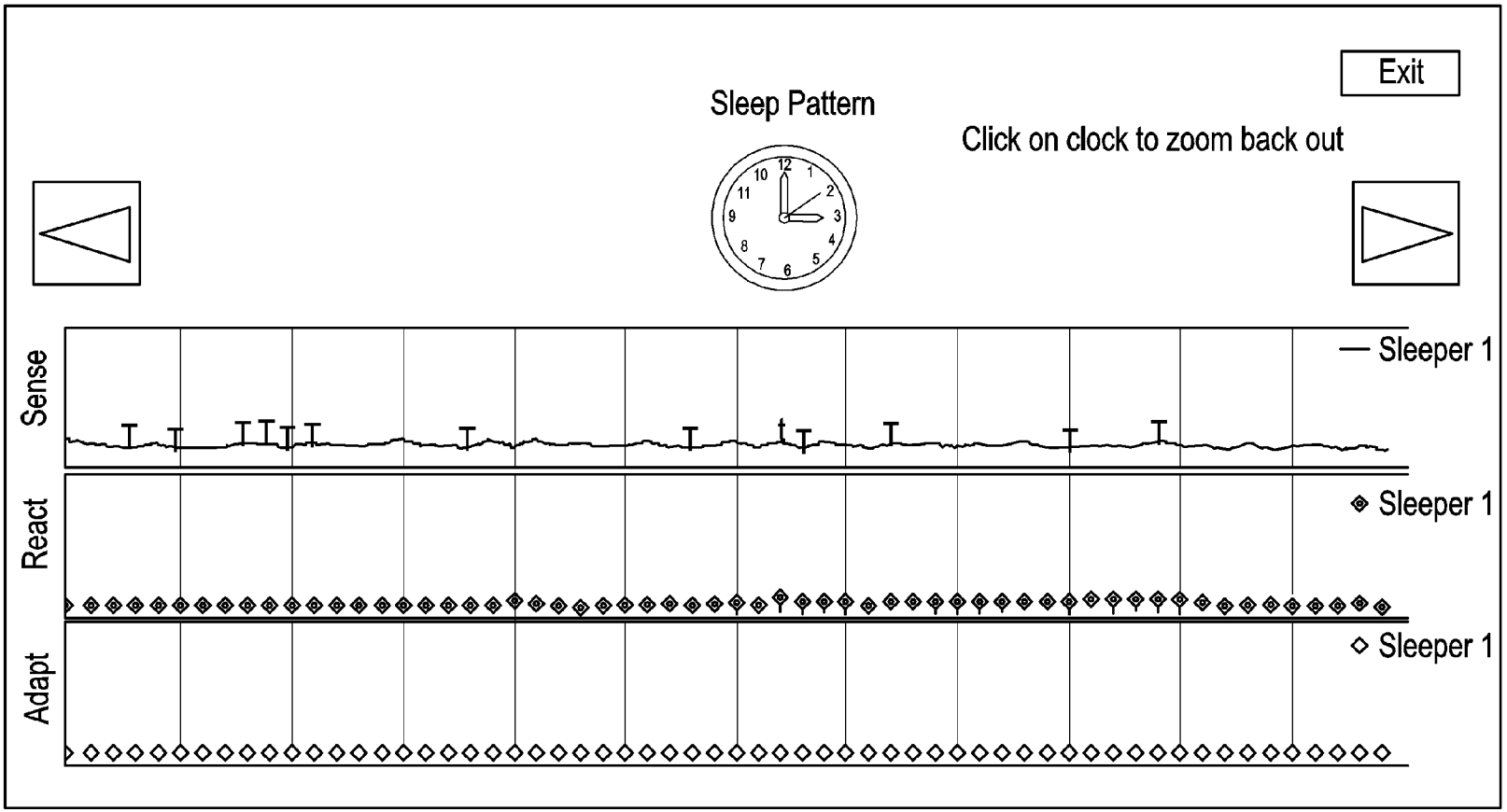
FIG. 12 is another documented image of a subject sleeping on an adjustable platform system providing an observed pattern, with each hour broken up into 5 minute time bands. A small "t" indicates a minor toss while a big "T" indicates a major toss. Position changes are indicated by bar movements in the React band.
Figure 13:
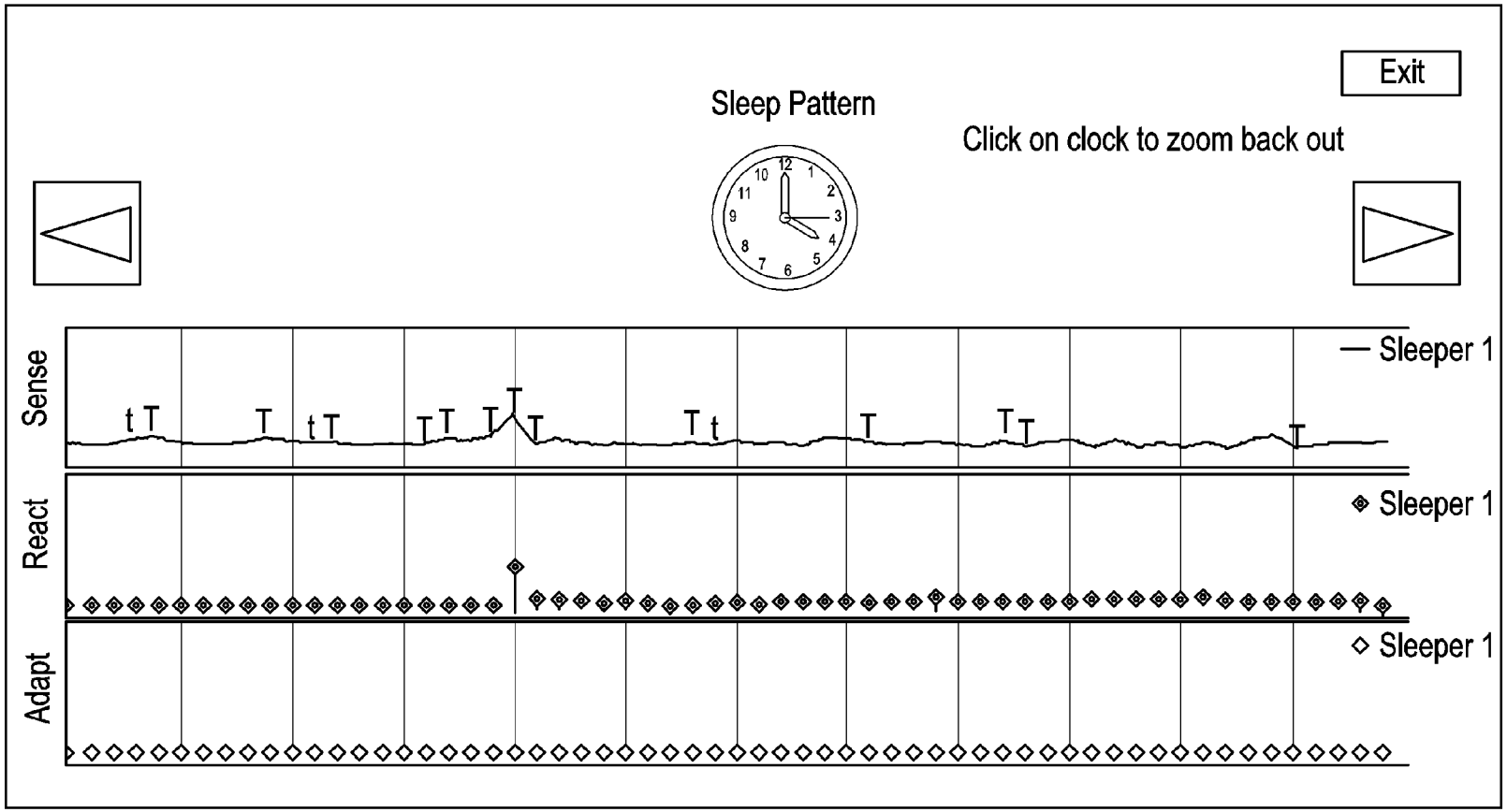
FIG. 13 is another documented image of a subject sleeping on an adjustable platform system providing an observed pattern, with each hour broken up into 5 minute time bands. A small "t" indicates a minor toss while a big "T" indicates a major toss. Position changes are indicated by bar movements in the React band.
Figure 14:
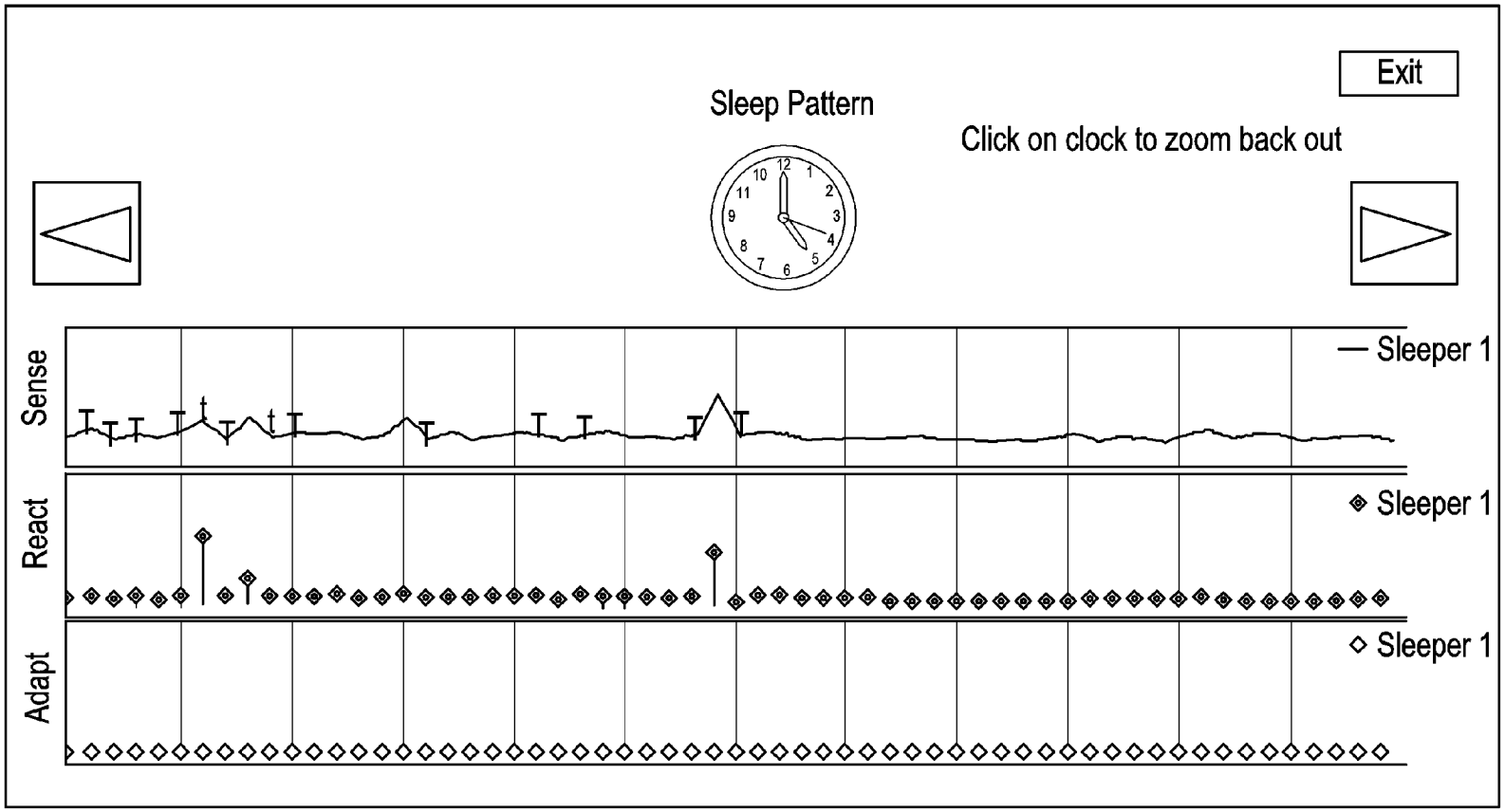
FIG. 14 is another documented image of a subject sleeping on an adjustable platform system providing an observed pattern, with each hour broken up into 5 minute time bands. A small "t" indicates a minor toss while a big "T" indicates a major toss. Position changes are indicated by bar movements in the React band.
Figure 15:
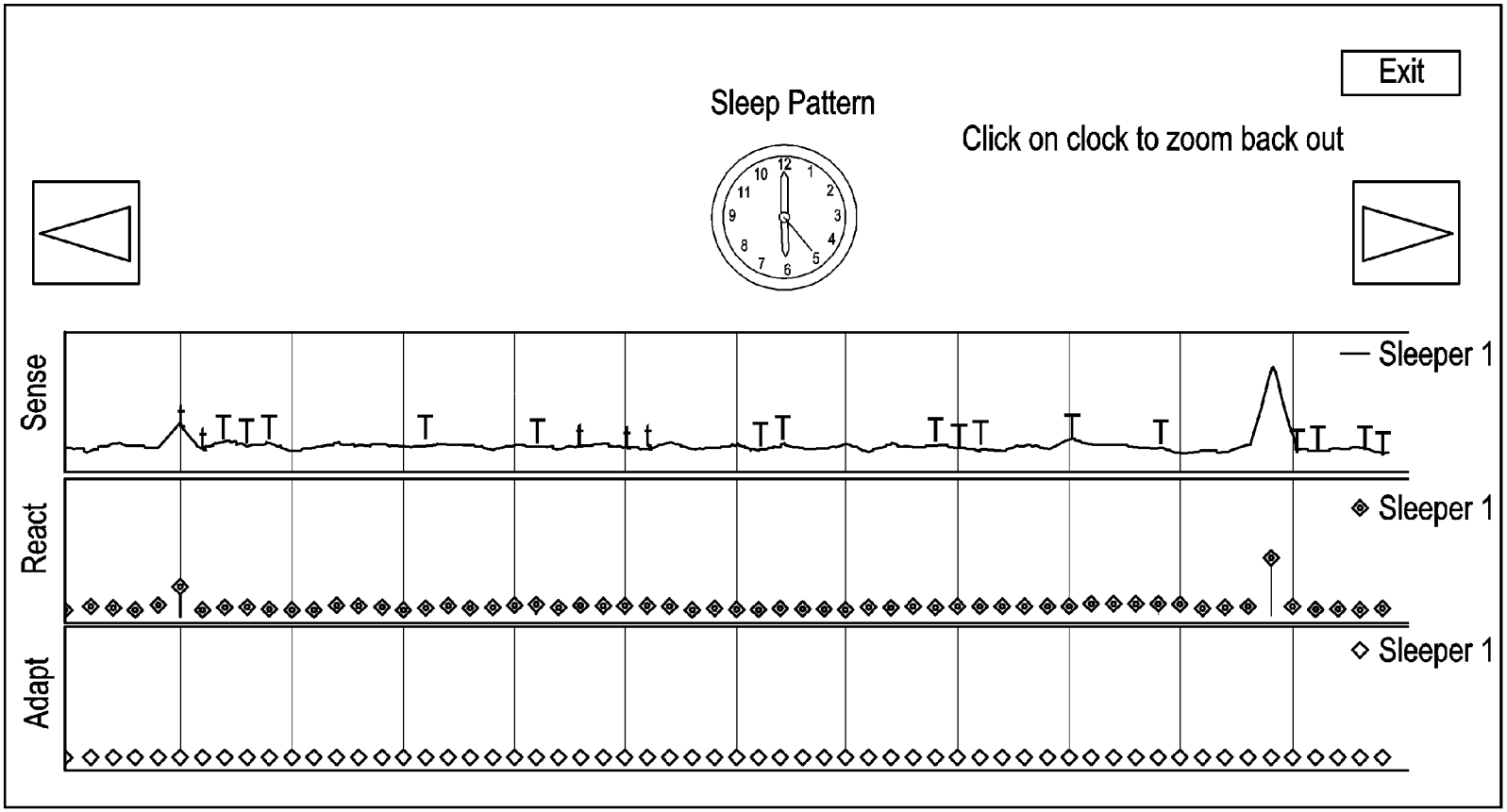
FIG. 15 is another documented image of a subject sleeping on an adjustable platform system providing an observed pattern, with each hour broken up into 5 minute time bands. A small "t" indicates a minor toss while a big "T" indicates a major toss. Position changes are indicated by bar movements in the React band.
Figure 16:
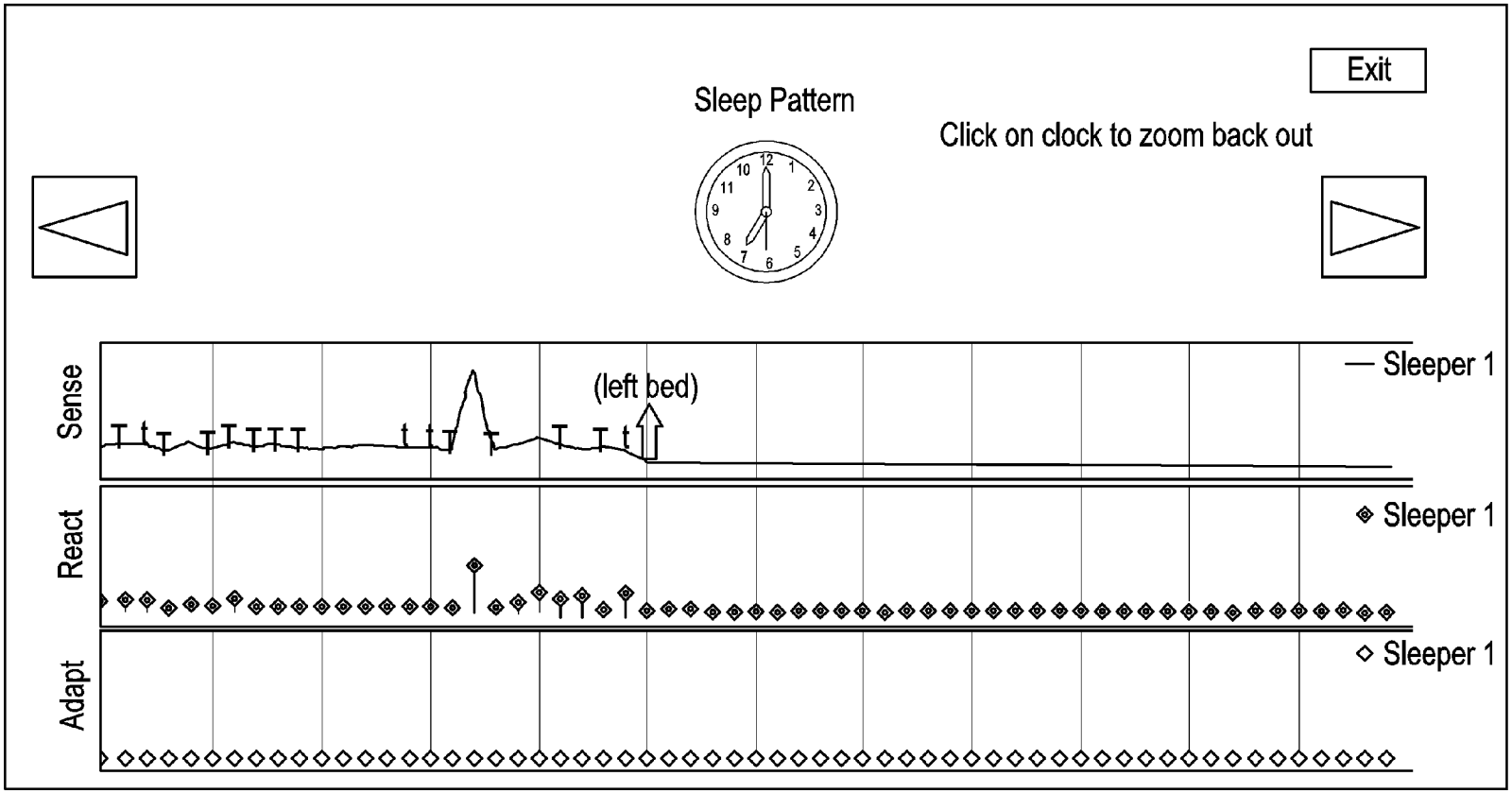
FIG. 16 is another documented image of a subject sleeping on an adjustable platform system providing an observed pattern, with each hour broken up into 5 minute time bands. A small "t" indicates a minor toss while a big "T" indicates a major toss. Position changes are indicated by bar movements in the React band.
Figure 17A:
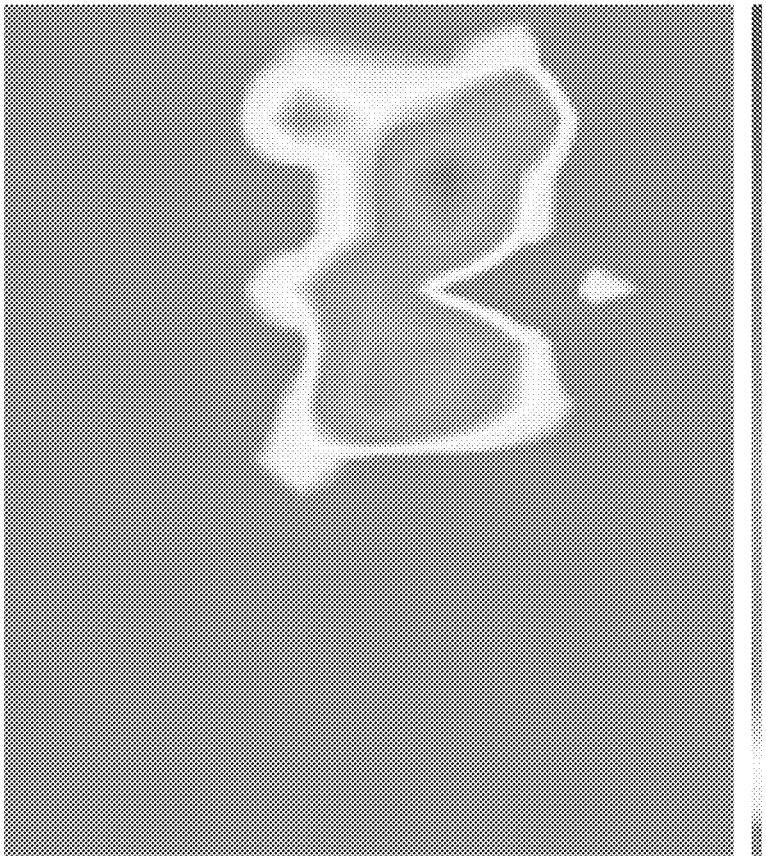
FIG. 17A is a picture of pressure images of a body sleeping on an adjustable platform system. This image is of a subject sleeping on the side. The colors are representative of the bladder pressures. The actual bladder pressures can be derived from the associated colors by looking at the color to number graph representation in FIG. 17B. The scale numbers are above the base point pressure of 0.40 psi. A dark purple section that shows 0.7 to 0.8 in the accompanying scale has an actual pressure of (0.40+0.80) about 1.2 psi gauge pressure (above atmosphere). High pressure zones are apparent below the shoulders and backside. It may be desirable to reduce pressure in the backside area via one or more of the pressure curves in an attempt to reduce the number of minor and major tosses.
Figure 17B:
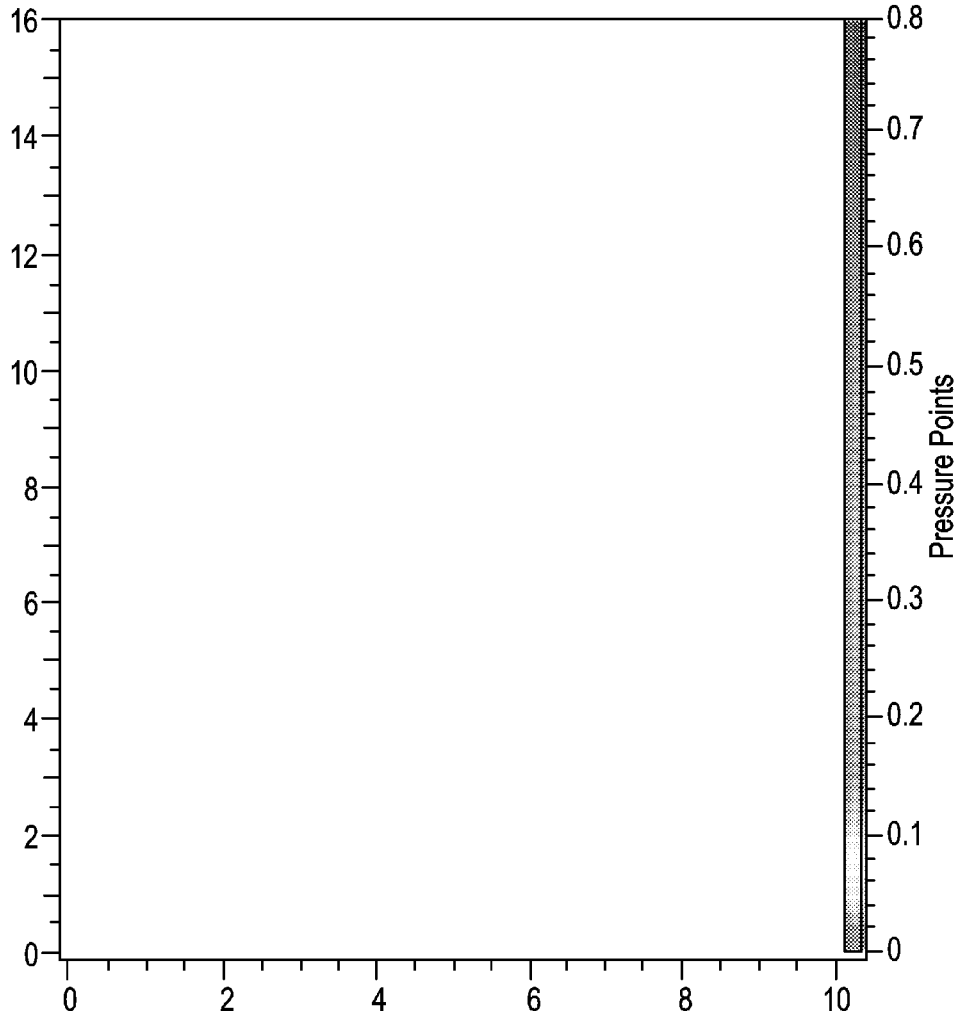
Figure 18:
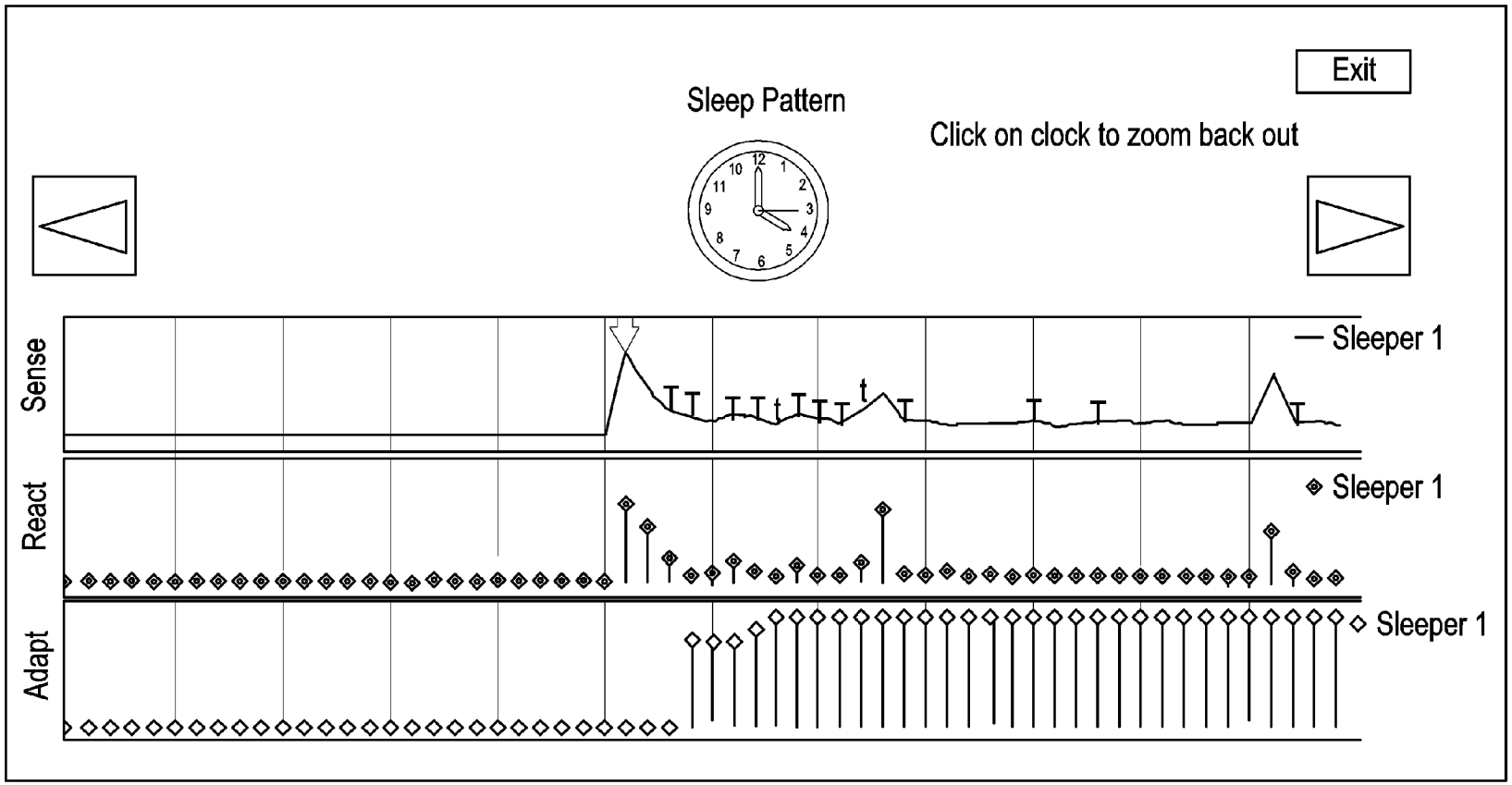
FIG. 18 is another documented image of a subject sleeping on an adjustable platform system providing an observed pattern, with each hour broken up into 5 minute time bands. A small "t" indicates a minor toss while a big "T" indicates a major toss. Position changes are indicated by bar movements in the React band. Also provided is an adaptive band. The bar height in this band represents which sleep curve is being applied to the sleeper at that point in time.

FIG. 8B is an enlarged view showing the sense and supply channels 50 for individual bladders 26. The bladder fill ports 52 convey fluid from the supply channel to the bladder that is located on the opposite side of the bladder base plate 24. The bladder supply channels may be, for instance, about 0.1, 0.125, 0.15, or 0.20 inches deep by about, for instance, 0.1, 0.125, 0.15, or 0.20 inches wide while the bladder fill port 52 may be about 0.1, 0.125, 0.15, or 0.20 inches in diameter.

FIG. 8C is an enlarged view showing the sense and supply channels from the fluid sensing and distributing apparatus 28 (FIG. 2A) that terminate at the gasket plate 29 (FIG. 2A). The interface port 54 hole pattern and hole size matches the hole pattern and hole size in the fluid sensing and distributing apparatus 28 (FIG. 2A) distribution plate through a matching hole pattern in the gasket plate 29 (FIG. 2A).

The pressure adjustable platform system may be used in conjunction with a fluid sensing and distribution apparatus as described in Codos, "A Fluid Sensing and Distributing Apparatus," copending U.S. application Ser. No. 61/675,901, filed Jul. 26, 2012, herein incorporated by reference.

The detailed description is representative of one or more embodiments of the invention, and additional modifications and additions to these embodiments are readily apparent to those skilled in the art. Such modifications and additions are intended to be included within the scope of the claims. One skilled in the art may make many variations, combinations and modifications without departing from the spirit and scope of the invention.

The invention claimed is:

1. A method of optimizing a pressure contour of a pressure adjustable platform system comprising:

(a) Measuring pressure in a plurality of bladders in the pressure adjustable platform system;

(b) Assessing whether a change in pressure in one or more of the plurality of bladders occurs;

(c) Determining whether a subject on the pressure adjustable platform system has adjusted position, moved or tossed;

(d) Generating an adaptive sleep algorithm; and (e) Adjusting the pressure in one or more bladders repeatedly and measuring the time between one or more repeats.

2. A method according to claim 1 further comprising after (c), providing a pressure image of the subject on the pressure adjustable platform system.

3. A method according to claim 2 wherein the pressure image is compared to known positional pressure images to determine a sleep position.

4. A method according to claim 1 further comprising after (d), providing a pressure profile curve.

5. A method according to claim 1 wherein (c) determining whether a subject on the pressure adjustable platform system has adjusted position, moved or tossed is performed by determining the number of bladders that have experienced a significant change in pressure.

6. A method according to claim 5 wherein a significant change in pressure is at least a 10% fluctuation in pressure within a bladder.

7. A method according to claim 1 wherein (d) generating an adaptive sleep algorithm is performed by generating a total sleeper movement number (TSMN).

8. A method according to claim 7 wherein the total sleeper movement number (TSMN) reflects quality of sleep.

9. A method according to claim 7 wherein the total sleeper movement number (TSMN) is repeatedly generated.

10. A method according to claim 1 wherein (e) adjusting the pressure in one or more bladders is performed using a pressure profile curve.

11. A method according to claim 1 further comprising after (c), providing a position profile curve.

12. A method according to claim 1 wherein (d) generating an adaptive sleep algorithm comprises the steps of quantifying minor tosses and major tosses.

13. A method according to claim 1 further comprising assessing quality of sleep of an individual on the pressure adjustable platform system.

14. A method according to claim 13 wherein assessing quality of sleep of an individual on the pressure adjustable platform system comprises calculating a total sleep movement number (TSMN) a sleep movement time (SMT) and a sleep quality number (SQN).

15. A method according to claim 1 further comprising determining a number of the plurality of bladders experiencing a change in pressure.

16. A method of optimizing a pressure contour of a pressure adjustable platform system having a plurality of bladders, a base plate, and a plurality of fluid channels wherein the fluid channels connect the bladders to an external sensor, wherein internal pressure of a plurality of the bladders may be adjusted, the method comprising:

(a) Measuring pressure in a plurality of bladders in the pressure adjustable platform system;

(b) Assessing whether a change in pressure in one or more of the plurality of bladders occurs;

(c) Determining whether a subject on the pressure adjustable platform system has adjusted position, moved or tossed;

(d) Providing a pressure image of the subject on the pressure adjustable platform system and comparing the pressure image to known positional pressure images to determine a sleep position;

(e) Generating an adaptive sleep algorithm; and (f) Adjusting the pressure in one or more bladders.

17. A method according to claim 16 further comprising after (d), providing a pressure profile curve.

18. A method according to claim 16 wherein (c) determining whether a subject on the pressure adjustable platform system has adjusted position, moved or tossed is performed by determining the number of bladders that have experienced a significant change in pressure.

19. A method according to claim 18 wherein a significant change in pressure is at least a 10% fluctuation in pressure within a bladder.

20. A method according to claim 16 wherein (d) generating an adaptive sleep algorithm is performed by generating a total sleeper movement number (TSMN).

21. A method according to claim 20 wherein the total sleeper movement number (TSMN) reflects quality of sleep.

22. A method according to claim 20 wherein the total sleeper movement number (TSMN) is repeatedly generated.

23. A method according to claim 16 wherein (e) adjusting the pressure in one or more bladders is performed using a pressure profile curve.

24. A method according to claim 16 further comprising after (d), providing a position profile curve.

25. A method according to claim 16 wherein (d) generating an adaptive sleep algorithm comprises the steps of quantifying minor tosses and major tosses.

26. A method according to claim 16 wherein (e) adjusting the pressure in one or more bladders is performed repeatedly.

27. A method according to claim 26 wherein (e) adjusting the pressure in one or more bladders is performed repeatedly and the time between one or more repeats is measured.

28. A method according to claim 16 further comprising assessing quality of sleep of an individual on the pressure adjustable platform system.

29. A method according to claim 28 wherein assessing quality of sleep of an individual on the pressure adjustable platform system comprises calculating a total sleep movement number (TSMN) a sleep movement time (SMT) and a sleep quality number (SQN).

30. A method according to claim 16 further comprising determining a number of the plurality of bladders experiencing a change in pressure.

* * * * *